US008684487B2

(12) United States Patent
Imoto

(10) Patent No.: US 8,684,487 B2
(45) Date of Patent: Apr. 1, 2014

(54) CONVEYING APPARATUS, LIQUID APPLYING APPARATUS, AND IMAGE FORMING APPARATUS

(75) Inventor: Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 826 days.

(21) Appl. No.: 12/298,650

(22) PCT Filed: Feb. 15, 2008

(86) PCT No.: PCT/JP2008/053107

§ 371 (c)(1),
(2), (4) Date: Oct. 27, 2008

(87) PCT Pub. No.: WO2008/108190

PCT Pub. Date: Sep. 12, 2008

(65) Prior Publication Data

US 2009/0102908 A1 Apr. 23, 2009

(30) Foreign Application Priority Data

Mar. 2, 2007 (JP) ..... 2007-053238

(51) Int. Cl.
*B41J 29/38* (2006.01)

(52) U.S. Cl.
USPC ..... 347/16

(58) Field of Classification Search
USPC ..... 347/16
See application file for complete search history.

(56) References Cited

U.S. PATENT DOCUMENTS

| | | | | |
|---|---|---|---|---|
| 6,161,828 | A | 12/2000 | Sussmeier | |
| 6,450,711 | B1 | 9/2002 | Conrow | |
| 2003/0156850 | A1* | 8/2003 | Tsutada | 399/45 |
| 2005/0220505 | A1* | 10/2005 | Hashimoto et al. | 399/322 |
| 2006/0038870 | A1 | 2/2006 | Nonaka | |
| 2006/0055754 | A1 | 3/2006 | Sakuma et al. | |
| 2006/0071411 | A1 | 4/2006 | Obuchi et al. | |
| 2006/0164491 | A1 | 7/2006 | Sakuma et al. | |
| 2006/0176352 | A1* | 8/2006 | Mihara et al. | 347/104 |
| 2006/0209153 | A1 | 9/2006 | Nishida et al. | |
| 2006/0256352 | A1 | 11/2006 | Kogure et al. | |

FOREIGN PATENT DOCUMENTS

| | | |
|---|---|---|
| EP | 1582940 A2 | 10/2005 |
| JP | 5-309971 | 11/1993 |
| JP | 10-323594 | 12/1998 |
| JP | 2000-1010 | 1/2000 |
| JP | 3109529 | 9/2000 |
| JP | 2003-248349 | 9/2003 |

(Continued)

OTHER PUBLICATIONS

Nov. 14, 2011 European search report in connection with counterpart European patent application No. 08 71 1871.

(Continued)

*Primary Examiner* — Uyen Chan N Le
*Assistant Examiner* — Hoang Tran
(74) *Attorney, Agent, or Firm* — Cooper & Dunham LLP

(57) ABSTRACT

A disclosed conveying apparatus includes plural conveyance paths arranged in parallel and configured to receive plural conveyance objects fed from an upstream side of the plural conveyance paths and convey the received plural conveyance objects to a conveyance destination situated at a downstream side of the plural conveyance paths. The plural conveyance paths are configured to convey the plural conveyance objects in the order in which the plural conveyance objects are received.

19 Claims, 22 Drawing Sheets

(56) References Cited

FOREIGN PATENT DOCUMENTS

| | | |
|---|---|---|
| JP | 2005-292651 | 10/2005 |
| JP | 2006-82546 | 3/2006 |
| JP | 2006-282349 | 10/2006 |
| JP | 2006-89204 | 4/2008 |

OTHER PUBLICATIONS

Mar. 13, 2012 Japanese official action in connection with a counterpart Japanese patent application.

* cited by examiner

CONVEYING APPARATUS, LIQUID APPLYING APPARATUS, AND IMAGE FORMING APPARATUS

TECHNICAL FIELD

The present invention relates to a conveying apparatus, a liquid applying apparatus, and an image forming apparatus.

BACKGROUND ART

Image forming apparatuses such as printers, facsimiles, copiers, and multi-function machines having the functions of a printer, a facsimile, and a copier, form images by conveying a medium (hereinafter also referred to as "paper") and applying a liquid (hereinafter also referred to as "recording liquid" or "ink") onto the medium. In forming the images, the image forming apparatus uses, for example, a liquid applying apparatus (e.g., liquid jet apparatus) including a recording head having a liquid jet head for jetting droplets of liquid (recording liquid). It is to be noted that image forming may also be referred to as recording, printing, image printing, or character printing. It is also to be noted that the material of the medium is not limited to a particular material. Thus, the medium may be also be referred to as a sheet of paper, a target medium, a recording medium, a transfer material, or a recording paper.

The image forming may be performed on a medium made of, for example, paper, thread, fiber, cloth, leather, metal, plastic, glass, wood, or ceramic. Furthermore, the image forming not only includes forming images which have meaning (e.g., characters, shapes) or forming images having no particular meaning (e.g., patterns), but also includes applying (coating) a material having a desired function onto a given area of a target medium. Furthermore, the liquid applying apparatus includes an apparatus that applies a liquid onto a target medium by using, for example, a liquid jet head, a roller, a brush, or a spray. Furthermore, the applied liquid is not limited to a recording liquid (ink). As long as it is a liquid, the applied liquid may also be, for example, a DNA sample, a resist material, a resin material, a patterning material, or a material having a desired function/property (e.g., an illuminating property, a light blocking property, a conductive property, a fixing function, a glossy property, a liquid absorbing function) and is not limited to a recording liquid or ink.

For example, in using an image forming apparatus that forms an image by applying a recording liquid onto a recording medium, the image forming apparatus requires some amount of time for waiting for the recording liquid to dry. Accordingly, during the period of waiting for the drying of the recording liquid, the image forming apparatus may keep the recording medium inside itself after performing the image forming process. In a case where the image forming apparatus performs double-side printing, the recording medium may be temporarily discharged to a sheet discharge tray after performing the image forming process on one side of the recording medium and fed back into the image forming apparatus for performing the image forming process on the other side of the recording medium.

For example, in an image forming apparatus shown in Japanese Registered Patent Publication No. 3109529, there is disclosed a delaying part for delaying the timing of discharging a recording medium for a predetermined period based on a predetermined value set according to the determination results of dot density of a previous recording.

As another example, in an image forming apparatus shown in Japanese Laid-Open Patent Application No. 2000-001010, there is disclosed a configuration of temporarily discharging at least a portion of a sheet of paper outside of the image forming apparatus after printing on one side of the paper in a double-side printing operation for obtaining time for the paper to dry.

As another example, in an image forming apparatus shown in Japanese Laid-Open Patent Application No. 2006-082546, there is disclosed a part that performs a paper discharging operation after a recording medium having an image formed thereon has both ends restrained until curling of the recording medium is unlikely to occur.

As another example, in an image forming apparatus shown in Japanese Laid-Open Patent Application No. 2003-248349, there is disclosed a configuration for temporarily delaying the timing of discharging a sheet of paper having a low fixing property (e.g., OHP) until the temperature of the OHP decreases.

As another example, in an image forming apparatus shown in Japanese Laid-Open Patent Application No. 2005-292651, there is disclosed a fixing apparatus including plural fixing parts for fixing a toner image on a sheet of paper, a roundabout conveying path for conveying the paper around at least one of the fixing parts, a main conveying path for conveying the paper via the roundabout conveying path, and a conveying path switching part for selecting a conveying path at a branching part between the roundabout conveying path and the main conveying path in which the time required for conveying the sheet through the roundabout conveying path is substantially equal to the time required for conveying the sheet through the main conveying path.

As another example, in a liquid applying apparatus using a brush or a roller, a sheet of paper is temporarily discharged from the apparatus until the paper becomes dry.

Meanwhile, in a typical image forming apparatus, a recording liquid having high viscosity (ink having high viscosity) is commonly used for achieving high speed recording and forming high quality images with respect to plain paper. Particularly, in a case where a pigment type ink (e.g., organic pigment, carbon black) is used as a coloring agent, a pigment is usually mixed together with a dispersant and dispersed in a stable state, to thereby obtain an aqueous ink. On the whole, the pigment type ink attains a high viscosity (no less than 5 mPa·s). Thus, in forming an image on plain paper, the pigment type ink exhibits a better quick-drying property than that of the dye type ink. Nevertheless, the pigment type ink has a tendency of causing curling of the recording medium.

More specifically, in using a dye type ink, moisture permeates from the back side of the recording medium to the front side of the recording medium and reduces the moisture difference between the front side of the recording medium and the back side of the recording medium. Therefore, although more drying time is required when using a dye type ink, curling due to moisture difference between the front and back side of the recording medium is relatively less likely to occur. On the other hand, in using a pigment type ink, due to its high quick-drying property, little time is required for the ink to dry. However, since time is required for the ink to sink (soak) into the recording medium, the moisture difference between the front side and the back side of the recording medium increases. This moisture difference leads to curling of the recording medium. In a case where such curl occurs, the recording medium may stiffen in the curled state due to the quick-drying property of the pigment type ink.

Therefore, conveying the recording medium in the curled state may cause jamming and adversely affect sheet-discharging steadiness. This results in a poorly printed recording medium.

Furthermore, although a pigment type ink has a high quick-drying property, smudging due to insufficient drying of ink may occur depending on the formula of ink or the type of paper used. Furthermore, the problem of drying which the pigment type ink faces is more serious in a case of using the dye type ink.

Thus, in a case where an insufficiently dried paper is conveyed, ink stains may adhere to a conveying part of an image forming apparatus. This may cause ink stains of the conveying part to re-adhere to a conveyed paper and cause the stains on the paper to adhere to other paper.

Furthermore, in one example of a liquid jet type image forming apparatus, paper may be flipped over (flipped upside down) and discharged from the liquid forming apparatus in a downward facing manner so that paper can be discharged (stacked) in an order corresponding to the order of printing on the paper. Therefore, in a case where curling occurs, the paper curls in a manner where the side opposite of the recorded side is facing upward, that is, in a manner where the ends of the paper are facing upward. Compared to a case of stacking the paper in a manner where the recorded side is facing upward, it is difficult to stack the paper on a discharged paper stacking part of the image forming apparatus.

Thus, demands for resolving the problems of curling of paper and staining of paper are growing. However, at the same time of resolving such problems, there is also a need to prevent productivity from decreasing due to decrease of throughput caused by correcting the curling or waiting for the drying of paper.

DISCLOSURE OF INVENTION

It is a general object of the present invention to provide a conveying apparatus, a liquid applying apparatus, and an image forming apparatus that substantially obviate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention can be realized and attained by a conveying apparatus, a liquid applying apparatus, and an image forming apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a conveying apparatus including: a plurality of conveyance paths arranged in parallel and configured to receive a plurality of conveyance objects fed from an upstream side of the plural conveyance paths and convey the received plural conveyance objects to a conveyance destination situated at a downstream side of the plural conveyance paths; wherein the plural conveyance paths are configured to convey the plural conveyance objects in the order in which the plural conveyance objects are received.

BEST MODE FOR CARRYING OUT THE INVENTION

Figure 1:
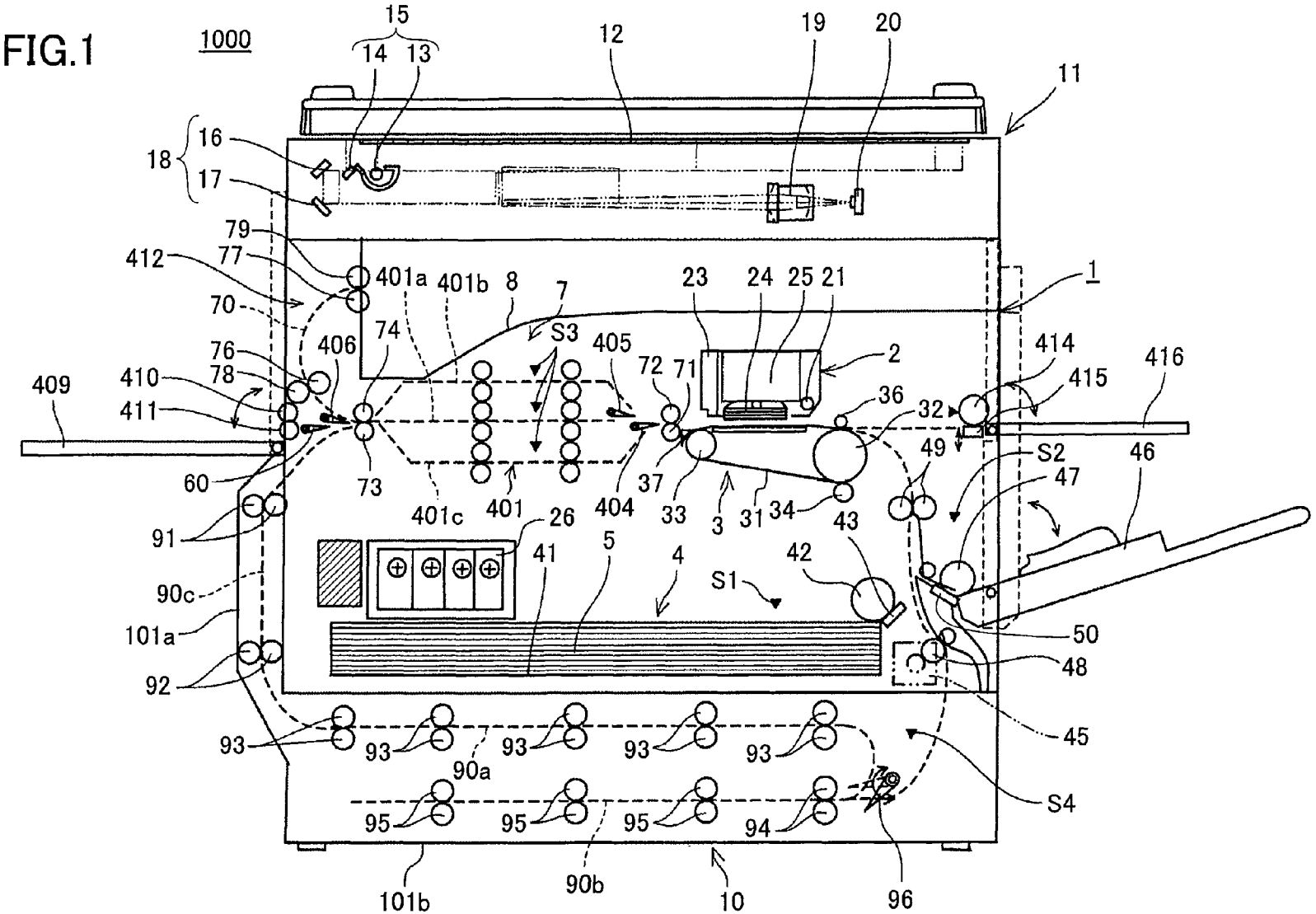
FIG. 1 is a schematic diagram showing an exemplary overall configuration of an image forming apparatus including a conveying apparatus according to a first embodiment of the present invention.

The present invention is described in detail based on the embodiments illustrated in the drawings.

First, an image forming apparatus (which is also a liquid applying apparatus) 1000 having a conveying apparatus 7 according to a first embodiment of the present invention is described with reference to FIGS. 1-4.

Figure 2:
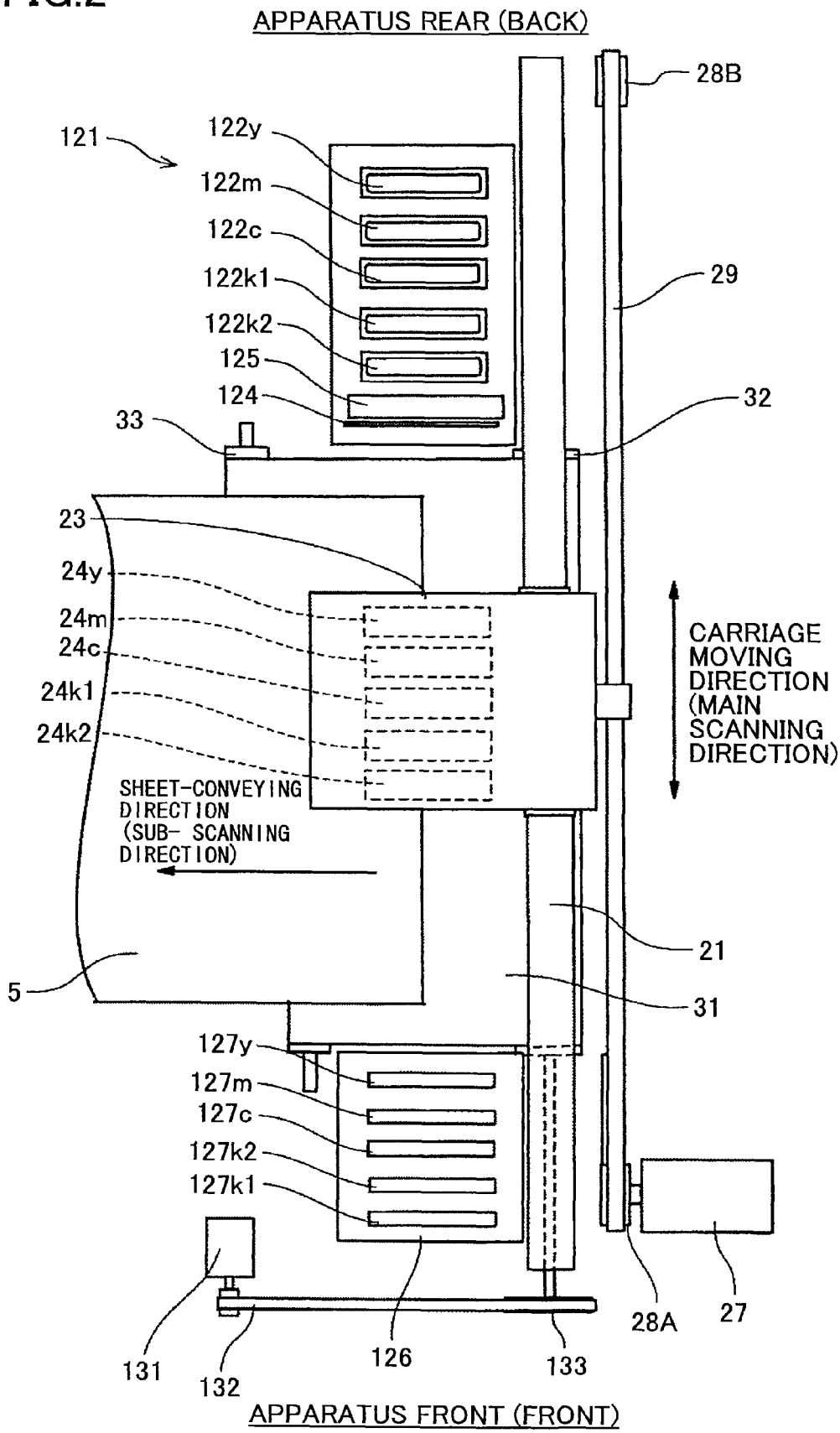
FIG. 2 is a plan view of an image forming part and a sub-scan conveying part of an image forming apparatus according to an embodiment of the present invention.
Figure 3:
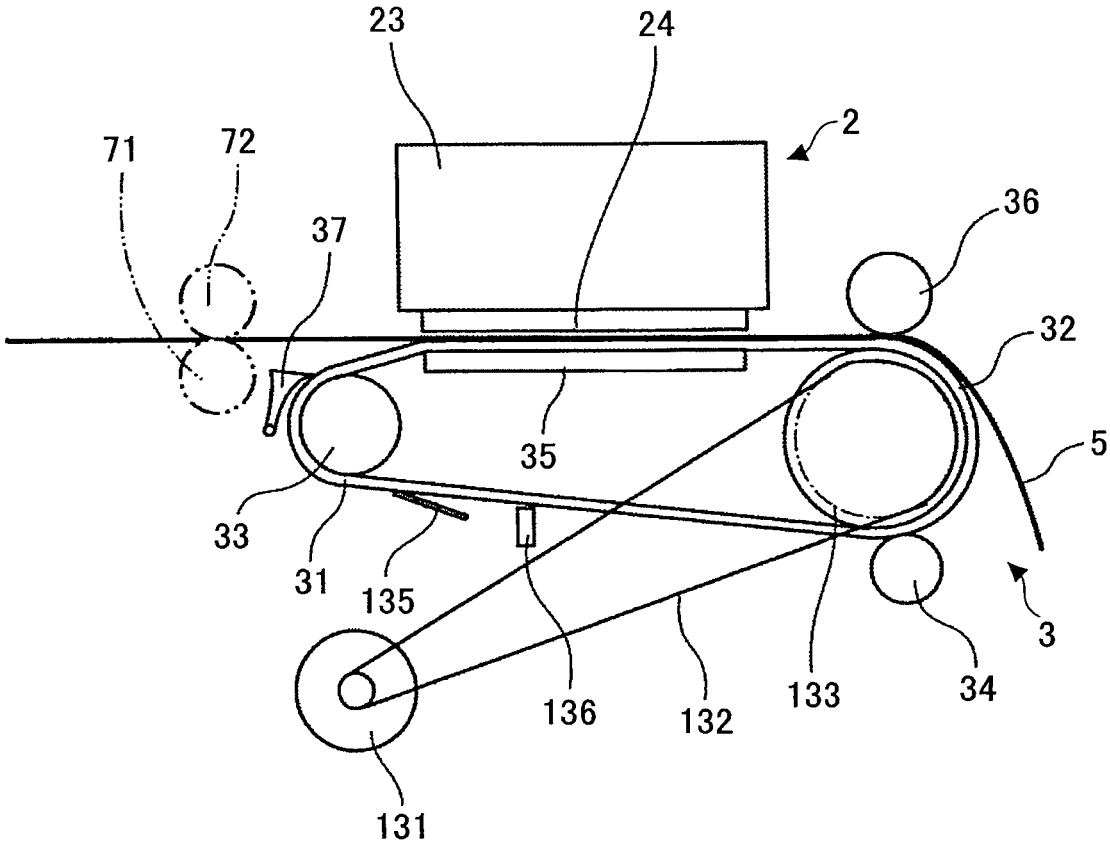
FIG. 3 is a side view of an image forming part and a sub-scan conveying part of an image forming apparatus according to an embodiment of the present invention.
Figure 4:
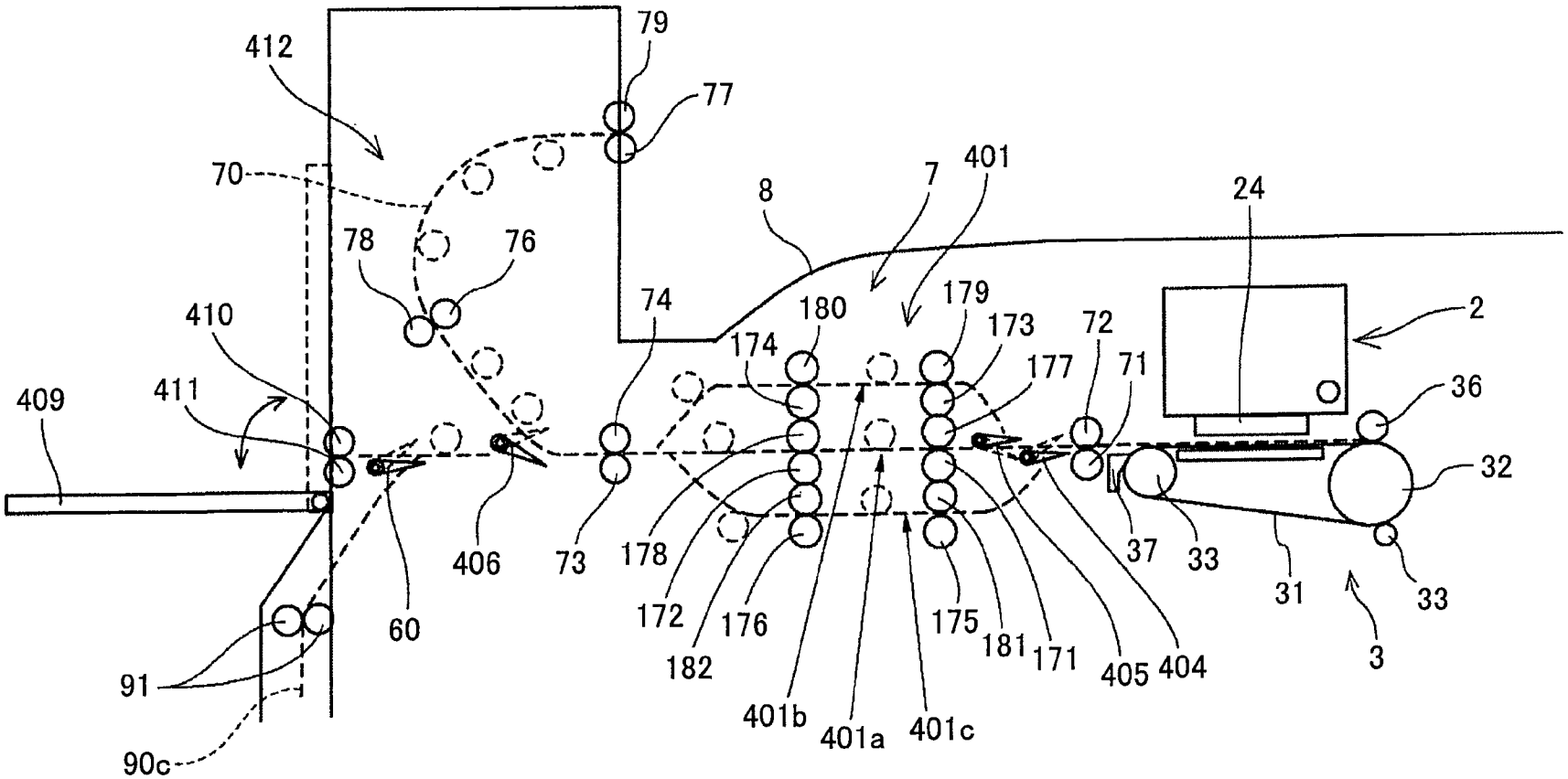
FIG. 4 is a schematic view showing a portion of a conveying part (conveying apparatus) included in an image forming apparatus according to an embodiment of the present invention.

FIG. 1 is a schematic diagram showing an exemplary overall configuration of the image forming apparatus 1000. FIG. 2 is a plan view of an image forming part 2 and a sub-scan conveying part 3 of the image forming apparatus 1000. FIG. 3 is a side view of the image forming part 2 and the sub-scan conveying part 3 of the image forming apparatus 1000. FIG. 4 is a schematic view showing a portion of a conveying part (conveying apparatus) 7.

The image forming apparatus 1000 has a main body 1. The main body 1 of the image forming apparatus 1000 has installed, for example, the image forming part 2 for forming images and the sub-scan conveying part 3. In the image forming apparatus 1000, paper (conveyance object) 5 is fed sheet by sheet from a sheet feed part 4 provided at a bottom portion of the main body 1. The paper 5 is fed to the sub-scan conveying part 3. Then, the sub-scan conveying part 3 conveys the paper 5 to an area facing the image forming part 2. The image forming part 2 forms (records) an image on the paper 5 by jetting liquid droplets onto the paper 5 conveyed by the sub-scan conveying part 3. Then, in a case of single-side printing, the paper 5 is discharged to a sheet-discharge tray 8 situated on an upper part of the main body 1 via a conveying part (conveying apparatus) 7. In a case of double-side printing, the paper 5 is conveyed to a double-side printing unit 10 provided at a bottom part of the main body 1 via the conveying part (conveying apparatus) 7. Then, the paper 5 is conveyed back to the sub-scan conveying part 3 (switch-back conveying). Then, the sub-scan conveying part 3 conveys the paper to the area facing the image forming part 2 for printing an image on the other side of the paper 5. Then, after images are formed on both sides of the paper 5, the paper 5 is discharged to the sheet-discharge tray 8.

The image forming apparatus 1000 also includes an image reading part (scanner part) 11 provided above the sheet-discharge tray 8 for reading images. The image reading part 11 serves as an inputting system for inputting image data (printing data) to be formed by the image forming part 2.

The image reading part 11 has a scanning optical system 15 including a light source 13 and a mirror 14 and another scanning optical system 18 including mirrors 16 and 17. By moving (scanning) the scanning optical systems 15 and 18, an image of a document placed on a contact glass 12 is read out. The image signals of the scanned document image are read by an image reading element 20 situated behind a lens 19 and converted to digital image data. Then, image processing is performed on the digital image data. Thereby, the processed image data can be printed out.

As other inputting systems for inputting image data (printing data) to be formed by the image forming part 2, there are, for example, a data processing apparatus (e.g., personal computer), an image reading apparatus (e.g., image scanner), and an imaging apparatus (e.g., digital camera) which are connected to the image forming apparatus 1000 via a cable or a network. Accordingly, data can be received from outside of the image forming apparatus 1000. Likewise, image processing is performed on the received data. Thereby, the processed image data can be printed out.

As shown in FIG. 2, the image forming part 2 of the image forming apparatus 1000 has a carriage 23 that is held movably in a main scanning direction by a guide rod 21 and a guide stay (not shown). The carriage 23 has a recording head 24 including liquid jetting heads 24*y*, 24*m*, 24*c*, 24*k*1, and 24*k*2 arranged in the main scanning direction for jetting liquid droplets of black, cyan, magenta, and yellow. A main scanning motor 27 moves the carriage 23 in the main scanning direction via a timing belt 29 wound around a driving pulley 28A and a driven pulley 28B.

The image forming apparatus 1000 according to an embodiment of the present invention is a shuttle type image forming apparatus which forms images by jetting liquid droplets from the recording head 24 while moving the carriage 23 in the main scanning direction and conveying the paper 5 in the sheet-conveying direction (sub-scanning direction) with the sub-scan conveying part 3.

It is to be noted that the image forming apparatus 1000 may use a line type head having liquid jetting heads of each color arranged in the sub-scanning direction. Furthermore, it is to be noted that the orientation of the recording head 24, the order of arranging the colors, and the orientation of the nozzles of the recording head 24 are not limited to those described above.

The recording head 24 according to an embodiment of the present invention has five liquid jetting heads 24*c*, 24*m*, 24*y*, 24*k*1, and 24*k*2 (simply referred to as "recording head 24" in a case of not distinguishing the liquid jetting heads of each color) corresponding to cyan ink (C), magenta ink (M), yellow ink (Y), and black ink (Bk) (two heads). The carriage 23 has sub-tanks 25 mounted thereon for supplying corresponding ink to the liquid jetting heads 24*c*, 24*m*, 24*y*, 24*k*1, and 24*k*2.

Furthermore, as shown in FIG. 1, ink cartridges (recording liquid cartridges) 26 containing black ink (Bk), cyan ink (C), magenta ink (M), and yellow ink (Y) can be detachably attached to a front side of the main body 1 for supplying ink to the corresponding sub-tanks 25. It is to be noted that black ink is supplied from a single ink cartridge 26 to two sub-tanks 25 according to an embodiment of the present invention.

The recording head 24 may be a piezoelectric type recording head using a piezoelectric element as a pressure generating part (actuating part) for applying pressure to ink contained inside an ink flow path. More specifically, the piezoelectric type recording head jets ink droplets by changing the volume of the ink flow path by changing the shape of a vibration plate forming a wall of the ink flow path. The recording head 24 may also be a thermal type recording head using a heating element. More specifically, the thermal type recording head jets ink droplets by heating the ink inside the ink flow path and generating bubbles in the ink flow path. The recording head 24 may also be an electrostatic type recording head having a vibration plate forming a wall of an ink flow path and an electrode positioned opposite of the vibration plate. More specifically, the electrostatic type recording head jets ink droplets by changing the volume of the ink flow path by changing the shape of the vibration plate with electrostatic force generated between the vibration plate and the electrode. It is, however, to be noted that the method of jetting the ink droplets is not limited to those described above.

As shown in FIG. 2, a maintenance/recovery apparatus 121 is provided at a non-printing area on one side of the image forming apparatus 1000 in the scanning direction of the carriage 23 (main scanning direction). The maintenance/recovery apparatus 121 is for maintaining (preserving) the nozzles of the recording head 24 and recovering the nozzles.

The maintenance/recovery apparatus 121 includes, for example, five moisture retention caps 122*k*2, 122*k*1, 122*c*, 122*m*, and 122*y* (simply referred to as "moisture retention cap 122" in a case of not distinguishing each color) for capping the nozzle faces of each of the liquid jetting heads 24*c*, 24*m*, 24*y*, 24*k*1, 24*k*2 of the recording head 24, an absorbing cap (not shown), a wiper blade 124 for wiping the nozzle faces of each liquid jetting head 24*c*, 24*m*, 24*y*, 24*k*1, 24*k*2 of the recording head 24, and a blank ejection receiving member 125 for jetting liquid droplets that do not contribute to image forming (recording).

As shown in FIG. 2, another blank ejection receiving member 126 is provided at a non-printing area on the other side of the image forming apparatus 1000 in the scanning direction of the carriage 23 (main scanning direction). The blank ejection receiving member 126 is for jetting liquid droplets that do not contribute to image forming (recording) from the five recording heads 24 (liquid jetting heads 24*c*, 24*m*, 24*y*, 24*k*1, 24*k*2). The blank ejection receiving member 126 is provided with five openings 127*k*2, 127*k*1, 127*c*, 127*m*, and 127 corresponding to the five recording heads 24 (liquid jetting heads 24*c*, 24*m*, 24*y*, 24*k*1, 24*k*2).

As shown in FIG. 3, the sub-scan conveying part 3 changes the direction of the paper 5 conveyed from below by an angle of approximately 90 degrees so that the paper 5 is conveyed facing the image forming part 2. The sub-scan conveying part 3 includes a conveying endless belt (conveyor belt) 31 wound around a conveying roller (driving roller) 32 and a tension roller (driven roller) 33, a charging roller (charging part) 34 for charging the surface of the conveyor belt 31, a guiding member 35 for guiding the conveyor belt 31 at an area facing the image forming part 2, a pressing roller (pressure roller) 36 for pressing the paper 5 against the conveyor belt 31 at an area facing the conveying roller 32, and a separating claw 37 for separating the paper 5 (on which an image is formed by the image forming part 2) from the conveyor belt 31. The charging roller 34 is charged with high alternating current from a high voltage power source (AC bias supplying part).

The conveyor belt 31 of the sub-scan conveying part 3 is rotated in a sheet-conveying direction (sub-scanning direction) as shown in FIG. 2 by having a sub-scan motor 131 rotate the conveying roller 32 via a timing belt 132 and a timing roller 133. The conveyor belt 31 according to an embodiment of the present invention has a double layer structure including a front surface serving as a paper attracting surface and a rear surface (medium resistance layer, earth layer). The front surface is formed of a pure resin material which is not subjected to resistance control. For example, the front surface may formed of an ETFE pure material. The rear surface may be formed of the same material as the front surface but subjected to resistance control by using carbon. It is, however, to be noted that the configuration of the conveyor belt 31 is not limited to the above. For example, the conveyor belt 31 may have a single layer structure or a structure of three or more layers.

Furthermore, a cleaning part 135 for removing paper particles or the like adhered to the surface of the conveyor belt 31 and a charge-removing brush 136 for removing charge on the surface of the conveyor belt 31 are provided between the driven roller 33 and the charging roller 34 of the sub-scan conveying part 3.

The sheet-feed part 4 includes a sheet-feed cassette 41, a sheet-feed roller 42, and a friction pad 43. The sheet-feed cassette 41 is removable from the front side of the main body 1 and is capable of having plural papers 5 stacked thereon. The sheet-feed roller 42 and the friction pad 43 are used to separate the plural papers 5 stacked on the sheet-feed cassette 41 and convey the separated papers 5 sheet by sheet.

Furthermore, the sheet-feed part 4 includes, for example, a manual sheet-feed tray 46, a manual sheet-feed roller 47, a friction pad 50, a straight sheet-feed tray 416, a straight manual sheet-feed roller 414, a straight manual sheet-feed friction pad 415, a conveying roller 48, and another conveying roller 49. The manual sheet-feed tray 46 is openable and closable between a position illustrated with broken lines and a position illustrated with solid lines in FIG. 1. The manual sheet-feed tray 46 is for stacking and feeding manually fed paper 5. The manual sheet-feed roller 47 and the friction pad 50 are for feeding the paper 5 sheet by sheet from the manual sheet-feed tray 46. The straight manual sheet-feed tray 416 is openable (positioned substantially horizontally when opened) and closable between a position illustrated with broken lines and a position illustrated with solid lines in FIG. 1. The straight manual sheet-feed tray 416 is for stacking and feeding paper 5 having a substantially high rigidity or an unbendable property (e.g., a plastic material such as a compact disk (CD), cardboard paper, glossy paper). The straight manual sheet-feed roller 414 is for feeding the paper 5 sheet by sheet from the straight manual sheet-feed tray 416. The straight manual sheet-feed friction pad 415 is oscillatable (driven by a driving source (not shown)) in an arrow direction shown in FIG. 1. The straight manual sheet-feed friction pad 415 is configured to release a separating operation of the papers 5 according to the type of paper 5 (e.g., the friction pad 415 releases the separating operation by moving in the arrow direction in a case of feeding a recording medium that is difficult to separate such as a medium made of plastic (CD), a medium made of metal, or Japanese paper). The conveying roller 48 is for conveying paper fed from, for example, the double-side printing unit 10 or an optional sheet-feed cassette mounted on a bottom part of the main body 1. The other conveying roller 49 is for conveying the fed paper 5 to the sub-scan conveying part 3.

The components used for conveying the paper 5 to the sub-scan conveying part 3 (e.g., sheet-feed rollers 42, 47, and 414) are rotatably driven by a sheet-feed motor (driving part) 45 including an HB type stepping motor via a sheet-feed clutch (not shown).

As shown in FIG. 4, the conveying part (conveying apparatus) 7 according to an embodiment of the present invention includes: a conveying roller 71; a spur 72 facing the conveying roller 72; branching plates 404 and 405; a first pair of conveying rollers 171 and 172; a second pair of conveying rollers 173 and 174; a third pair of conveying rollers 175 and 176; a first pair of spurs 177 and 178 facing the first pair of conveying rollers 171 and 172; a second pair of spurs 179 and 180 facing the second pair of conveying rollers 173 and 174; and a third pair of spurs 181 and 182 facing the third pair of conveying rollers 175 and 176. The conveying roller 71 and the spur 72 are configured to convey the paper separated by the separating claw 37 of the sub-scan conveying part 3. The branching plates 404 and 405 are oscillatable between a position illustrated with broken lines and a position illustrated with solid lines in FIG. 4. The branching plates 404 and 405 are configured to switch between plural conveyance paths 401 (including a first conveyance path 401*a*, a second conveyance path 401*b*, and a third conveyance path 401*c*) for conveying the paper 5 on which an image is formed by the image forming part 2. The first pair of conveying rollers 171, 172 and the first pair of spurs 177, 178 are provided at the first conveyance path 401*a* for holding and conveying the paper 5 from the top and bottom of the first conveyance path 401*a*. The second pair of conveying rollers 173 and 174 are provided at the second conveyance path 401*b* for holding and conveying the paper 5 from the top and bottom of the second conveyance path 401*b*. The third pair of conveying rollers 175 and 176 are provided at the third conveyance path 401*c* for holding and conveying the paper 5 from the top and bottom of the third conveyance path 401*c*. By utilizing the spurs 177-182 in the first-third conveyance paths 401*a*-401*c*, an undried (moist) medium (in this example, an undried paper having an image formed thereon) can be conveyed without being stained.

The first-third conveyance paths 401*a*-401*c* merge at an area in front of a pair of conveying rollers 73, 74. By having the plural conveyance paths 401 merge into a single conveyance path at a point before the paper 5 reaches its destination (conveyance destination), the components required after the merging can be commonly shared. In other words, after the merging point, there is no need to provide components for each of the conveyance paths 401. Thereby, size-reduction of the image forming apparatus 1000 can be achieved and the number of components beyond the merging point can be reduced. As a result, manufacturing cost of the image forming apparatus 1000 can be reduced.

A sheet discharge part 412 according to an embodiment of the present invention includes a pair of conveying rollers 73 and 74, a first branching plate 406; a second branching plate 60, a first pair of sheet-discharge rollers 76 and 78, a second pair of sheet-discharge rollers 77 and 79, and a pair of straight sheet-discharge rollers 410 and 411. The pair of conveying rollers 73 and 74 are configured to convey the paper 5 to a sheet-discharge conveyance path 70, the double-side printing unit 10, or a straight sheet-discharge tray 409 which is openable and closable between a position illustrated with solid lines and a position illustrated with broken lines in FIG. 4. The first branching plate 406 is oscillatable between a position illustrated with broken lines and a position illustrated with solid lines in FIG. 4. The first branching plate 406 is configured to switch between the sheet-discharge conveyance path 70, a conveyance path extending toward both the double-side printing unit 10 (vertical double-side printing conveyance path 90*c*) and the straight sheet-discharge tray 409. The second branching plate 409 is oscillatable between a position illustrated with broken lines and a position illustrated with solid lines in FIG. 4. The second branching plate 409 is configured to switch between a conveyance path extending to the double-side printing unit 10 (vertical double-side printing conveyance path 90*c*) and a conveyance path extending to the straight sheet-discharge tray 409. The first and second pairs of sheet-discharge rollers 76, 78, 77 and 79, are configured to convey the paper 5 to the sheet-discharge tray 8. The pair of straight sheet-discharge rollers 410 and 411 is configured to convey the paper 5 to a straight sheet-discharge tray 409. It is to be noted that the paper 5 is discharged to the sheet-discharge tray 8 in a manner having its printed image facing downward. Thereby, papers 5 can be stacked in accordance with the order of printing the papers 5.

Among the above-described pairs of rollers, it is preferable that the rollers 74, 76, 77, and 410 be configured as spurs. Thereby, the amount of stain carried by the rollers can be reduced. It is also preferable to dispose the spurs at positions not facing the conveying rollers. For example, it is preferable to dispose the spurs at positions illustrated with broken-line circles in FIG. 4. This prevents a conveying guide (not shown) from contacting the side of the paper 5 on which an image is formed (i.e. prevents staining of the paper 5).

The branching plate 404, which is situated downstream of the conveying roller 71, is configured to switch the path of the paper 5 conveyed from upstream. More specifically, the branching plate 404 oscillates between the side toward the first and second conveyance paths 401*a*, 401*b* (position where the branching plate 404 is illustrated with solid lines in FIG. 4) and the side toward the third conveyance path 401*c* (position where the branching plate 404 is illustrated with broken lines in FIG. 4) for switching between the first and second conveyance paths 401*a*, 401*b* and the third conveyance path 401*c*. In a case where the branching plate 404 is in the position illustrated with solid lines, the paper 5 is guided to the side where the first pair of conveying rollers 171, 172, the second pair of conveying rollers 173, 174, the first pair of spurs 177, 178, and the second pair of spurs 179, 180 are provided along the first and second conveyance paths 401*a*, 401*b*. In a case where the branching plate 404 is in the position illustrated with broken lines, the paper 5 is guided to the side where the third pair of conveying rollers 175, 176 and the third pair of spurs 181, 182 are provided along the third conveyance path 401*c*.

Furthermore, the branching plate 405, which is also situated downstream of the conveying roller 71, is configured to switch the path of the paper 5 conveyed from upstream. More specifically, the branching plate 404 oscillates between the side toward the first conveyance path 401*a* (position where the branching plate 405 is illustrated with solid lines) and the side toward the second conveyance path 401*b* (position where the branching plate 405 is illustrated with broken lines in FIG. 4) for switching between the first conveyance path 401*a* and the second conveyance path 401*b*. In a case where the branching plate 405 is in the position illustrated with solid lines, the paper 5 is guided to the side where the first pair of conveying rollers 171, 172 and the first pair of spurs 177, 178 are provided along the first conveyance path 401*a*. In a case where the branching plate 405 is in the position illustrated with broken lines, the paper 5 is guided to the side where the second pair of conveying rollers 173, 174 and the second pair of spurs 179, 180 are provided along the second conveyance path 401*b*.

The double-side printing unit 10 includes a vertical conveying part 101*a* and a horizontal conveying part 101*b* that form a united body. The vertical conveying part 101*a* includes the vertical double-side printing conveyance path 90*c* located at a side part of the main body 1. The double-side printing conveyance path 90*c* is configured to receive the paper 5 guided from the branching plates 406 and 60 and convey the paper downward to the horizontal conveying part 101*b*. The horizontal conveying part 101*b* includes a horizontal fetching conveyance path 90*a* and a switchback conveyance path 90*b*.

The vertical double-side printing conveyance path 90*c* includes a pair of entrance double-side rollers 91 configured to convey the paper 5 downward and a pair of conveying rollers 92 configured to deliver the paper 5 to the horizontal fetching conveyance path 90*a*. The horizontal fetching conveyance path 90*a* includes, for example, five pairs of double-side conveying rollers 93. The switchback conveyance path 90*b* includes plural reversible rollers for flipping over the paper 5 from the horizontal fetching conveyance path 90*a* and re-feeding the flipped over paper 5 to the pair of conveying rollers 48. In this example, the switchback conveyance path 90*b* includes a pair of exit double-side rollers 94 and three pairs of double-side conveying rollers 95.

The double-side printing unit 10 also includes an oscillatable branching plate 96 configured to switch between the path for conveying the paper 5 from the fetching conveyance path 90*a* to the switchback conveyance path 90*b* and the path for conveying the paper from the switchback conveyance path 90*b* to the pair of conveying rollers 48. The branching plate 96 oscillates between a position illustrated with solid lines (switchback side) and a position illustrated with broken lines (re-feed side).

The first branching plate 406, which is situated downstream of the pair of sheet-discharge conveying rollers 73, 74, is configured to switch the path of the paper 5 between the path extending to the sheet-discharge tray 8, the path extending to the double-side printing unit 10, and the path extending to the straight sheet-discharge tray 409. More specifically, the first branching plate 406 oscillates between the side toward the sheet-discharging side (position where the first branching plate 406 is illustrated with solid lines in FIG. 4) and the side toward the double-side printing side (position where the first branching plate 406 is illustrated with broken lines in FIG. 4). In a case where the first branching plate 406 is in the position of the sheet-discharge side, the paper 5 is guided to the side where the first and second pairs of sheet-discharge rollers 76, 78, 77 and 79, are provided. In a case where the first branching plate 406 is in the position of the double-side printing side, the paper 5 is guided to the side where the sheet-discharge tray 409 or the side where the pair of entrance double-side rollers 91 is provided.

The second branching plate 60 is configured to switch the path of the paper 5 between the path extending to the straight sheet-discharge tray 409 and the path extending to the double-side printing unit 10. More specifically, the second branching plate 60 oscillates between the sheet-discharge side (position where the second branching plate 60 is illustrated with solid lines) and the double-side printing side (position where the second branching plate 60 is illustrated with broken lines). In a case where the second branching plate 60 is in the position of the sheet-discharge side, the paper 5 is guided to the side where the pair of sheet-discharge rollers 410 and 411 is provided. In a case where the second branching plate 60 is in the position of the double-side printing side, the paper 5 is guided to the side where the pair of entrance double-side rollers 91 is provided.

Furthermore, although not shown in the drawings, the image forming apparatus 1000 includes an image start sensor located at an upstream side of the image forming part 2 with respect to the paper conveying direction and an image end sensor located at a downstream side of the image forming part 2 with respect to the paper conveying direction. The image start sensor is configured to detect a front end of the paper 5, whereas the image end sensor is configured to detect a rear end of the paper 5.

Figure 5:
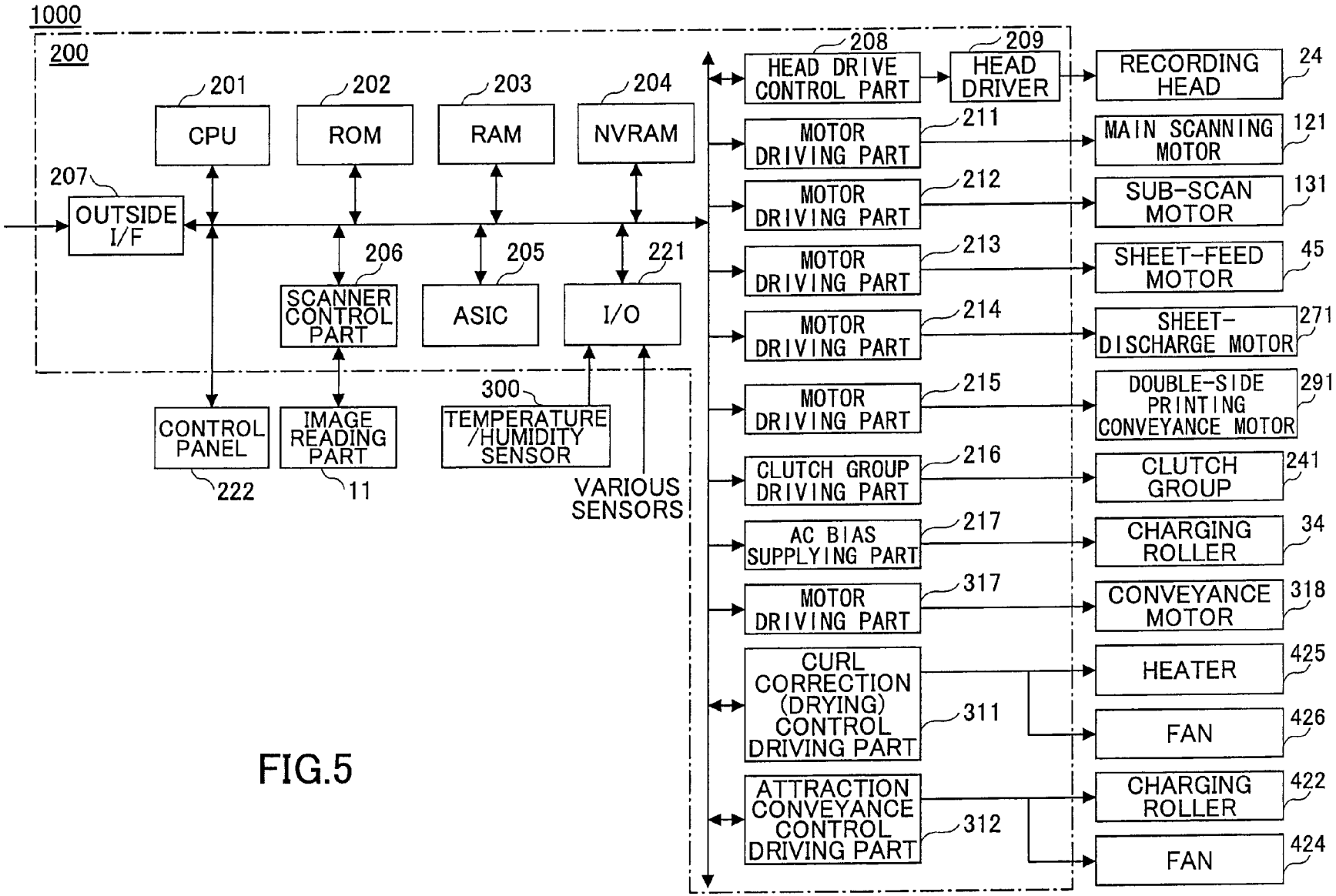
FIG. 5 is a block diagram of a control part included in an image forming apparatus according to an embodiment of the present invention.

Next, an exemplary configuration of a control part 200 included in the image forming apparatus 1000 is described with reference to FIG. 5. FIG. 5 is a block diagram showing the control part 200 according to an embodiment of the present invention.

The control part 200 according to an embodiment of the present invention includes: a CPU 201 for managing the overall control of the image forming apparatus 1000; a ROM 202 for storing programs and data executed by the CPU 201; a RAM 203 is for temporarily storing, for example, image data (printing data); a non-volatile memory (NVRAM) 204 for storing data even where the power of the image forming apparatus 1000 is turned off; an ASIC 205 is for processing input/output signals (e.g., processing various signals corresponding to image data, rearranging of image data, and controlling the entire image forming apparatus 1000); and a scanner control part 206 for reading image data by using the image reading part 11 or processing the read out image data.

The control part 200 according to an embodiment of the present invention also includes: an I/F (external interface) 207 for sending and receiving data and signals in a case of using data received from an apparatus outside of the image forming apparatus 1000; a head drive control part 208 and a head driver 209 for controlling the drive of the recording head 24 of the image forming section 2; and motor driving parts 211-215, and 317 including motor drivers for independently driving various motors (drive sources) such as a main scanning motor 121 for moving the carriage 23 in the main scanning direction, a sub-scanning motor 131 for rotating the conveyor belt 31 by rotating the conveying roller 32, a sheet-feed motor 45, a conveyance motor 318 for driving the rotation of the rollers of the conveying part 7 (conveying path 401), a sheet-discharge motor 271 for driving the rotation of the rollers of the sheet-discharge conveyance path 70, and a double-side printing conveyance motor 291 for driving the rotation of the rollers of the double-side printing unit 10.

The control part 200 according to an embodiment of the present invention also includes a clutch driving part 216 for driving a group of clutches (clutch group) 241. In this example, the clutch group 241 includes: a sheet-feed electromagnetic clutch (not shown) for separately driving the rotation of the sheet-feed rollers 42, 47, 414; another electromagnetic clutch (not shown) for separately driving the rotation of the rollers provided in the conveyance paths 401*a*, 401*b*, and 401*c*; a solenoid (not shown) for oscillating the branching plate 404 between the side of the third conveyance path 401*c* and the side of the first and second conveyance paths 401*a*, 401*b*; another solenoid (not shown) for oscillating the branching plate 405 between the side of the first conveyance path 401*a* and the side of the second conveyance path 401*b*; another solenoid (not shown) for oscillating the branching plate 406 between the side of the sheet-discharge tray 8 and the side including the double-side printing unit 10 and the straight sheet-discharge tray 409; another solenoid (not shown) for oscillating the branching plate 60 between the straight sheet-discharge tray 409 and the double-side printing unit 10; and another solenoid (not shown) for oscillating the branching plate 96 between the switchback side and the re-feed side.

The control part 200 according to an embodiment of the present invention also includes: an AC bias supplying part 217 for applying AC bias voltage (high voltage) to the charging roller 34; a heater part 425 for heating the paper at the conveyance path (standby conveyance path) 401; a fan (air current generating part) 426 for generating an air current (e.g., warm air, cool air) for facilitating drying of the paper 5 on the conveyance path 401; a curl correction (drying) control driving part 311 for driving the drying operation of the fan 426; an attraction conveyance control driving part 312 for attracting the paper 5 onto the conveyance path 401 by electrostatic attraction with use of a charging roller 422 or by air suction with use of an attraction fan 424.

The control part 200 according to an embodiment of the present invention also includes an I/O 221 for receiving detection signals from a temperature/humidity sensor 300 for detecting ambient temperature and humidity as well as detection signals from other sensors (e.g., image start sensor, image end sensor not shown). Furthermore, the control part 200 according to an embodiment of the present invention also includes a control panel 222 for inputting and displaying data used by the image forming apparatus 1000.

The temperature/humidity sensor 300 is located at least in one of the areas indicated as sensors S1-S4 in FIG. 1. By positioning the temperature/humidity sensor 300 in the vicinity of the sheet-feed cassette 41 on which the paper (recording medium) 5 is stacked, the temperature and humidity surrounding the stacked sheets of paper 5 can be detected, to thereby obtain the amount of moisture contained in the paper 5 to be fed by the sheet-feed cassette 41. Thus, control for preventing curling of the paper 5 can be executed with high precision. By positioning the temperature/humidity sensor 300 in the vicinity of the area where the paper 5 is conveyed after having an image formed thereon (area indicated as sensor S3 of the conveying part 7 in FIG. 1), the temperature and humidity surrounding the paper 5 having an image formed thereon can be detected, to thereby obtain the dryness of the paper 5 having an image formed thereon. Thus, control for preventing curling of the paper 5 can be executed with high precision.

It is to be noted that the temperature/humidity sensor 300 may also be positioned in the area capable of detecting the temperature and humidity surrounding the paper 5 fed by the sheet-feed cassette 41 (area indicated as sensor S2 in FIG. 1). Furthermore, the temperature/humidity sensor 300 may also be positioned in the area capable of detecting the temperature and humidity surrounding the paper 5 re-fed from the switch-back conveyance path 90*b* (area indicated as sensor S4 in FIG. 1).

In a case where an image (image data) of a document is read out by the image reading part 11, read image data are processed and stored in a buffer in the scanner control part 206. In a case where the image forming apparatus 1000 receives image data (e.g., printing data) from an outside apparatus such as a data processing apparatus (e.g., personal computer), an image reading apparatus (e.g., scanner), or a capturing apparatus (e.g., digital camera) via the external I/F 207, a reception buffer inside the external I/F 207 stores the received image data.

The CPU 201 reads out the image data stored in the scanner control part 206 or the I/F 207 and analyzes the image data. Then, the CPU 201 performs, for example, image processing on the image data or re-arranging the image data by using the ASIC 205. Then, the CPU 201 transfers the processed image data to the head drive control part 208. In outputting an image by generating dot pattern data based on the data received from an outside apparatus, font data may be stored, for example, in the ROM 202. Furthermore, image data may be processed into bitmap data by a printer driver of an outside apparatus and transferred to the image forming apparatus 1000.

The head drive control part 208, upon receiving image data (dot pattern data) amounting to a single line of data that can be output by each recording head 24, transfers the received dot pattern data to the head driver 209. Then, the head driver 209 drives each of the recording heads 24 by selectively applying a driving waveform to an actuating part of the recording head 24 based on the dot pattern data. Accordingly, each recording head 24 jets liquid droplets from a predetermined nozzle based on the drive applied from the actuating part.

In performing an image forming operation with the above-described the image forming apparatus 1000 according to an embodiment of the present invention, the paper 5 is fed sheet by sheet from the sheet conveying part 4 or the double-side printing unit 10. Then, the paper 5 is pressed against the conveyor belt 31 by the pressure roller 36 so that its conveying direction is changed approximately 90 degrees. Then, the paper 5 is electrostatically attracted onto the conveyor belt 31 and conveyed in the sub-scanning direction by the rotation of the conveyor belt 31.

Then, by driving the recording head 24 according to received image signals while moving the carriage 23 above the paper 5 placed (fixed) on the conveyor belt 31, ink droplets are jetted onto the paper 5 for recording a single line of data on the paper 5. After recording the single line of data on the paper 5, the paper 5 is conveyed a single line forward for recording data on the next line. By intermittently conveying the paper 5 in this manner, an image is formed on the paper 5.

The image forming operation is completed upon receiving a recording completion signal or a signal indicating that the rear end of the paper 5 has reached a recording area.

Then, after a standby process (described in detail below) is performed in the first-third conveyance paths 401*a*-401*c* in the conveying apparatus 7, the paper 5 is conveyed to the sheet-discharge tray 8, the straight sheet-discharge tray 409, or the double-side printing unit 10.

Next, the standby process (process of controlling conveyance including delaying of conveyance for waiting for curl correction (drying) is described with reference to the flowcharts shown in FIGS. 6-8.

Figure 6:
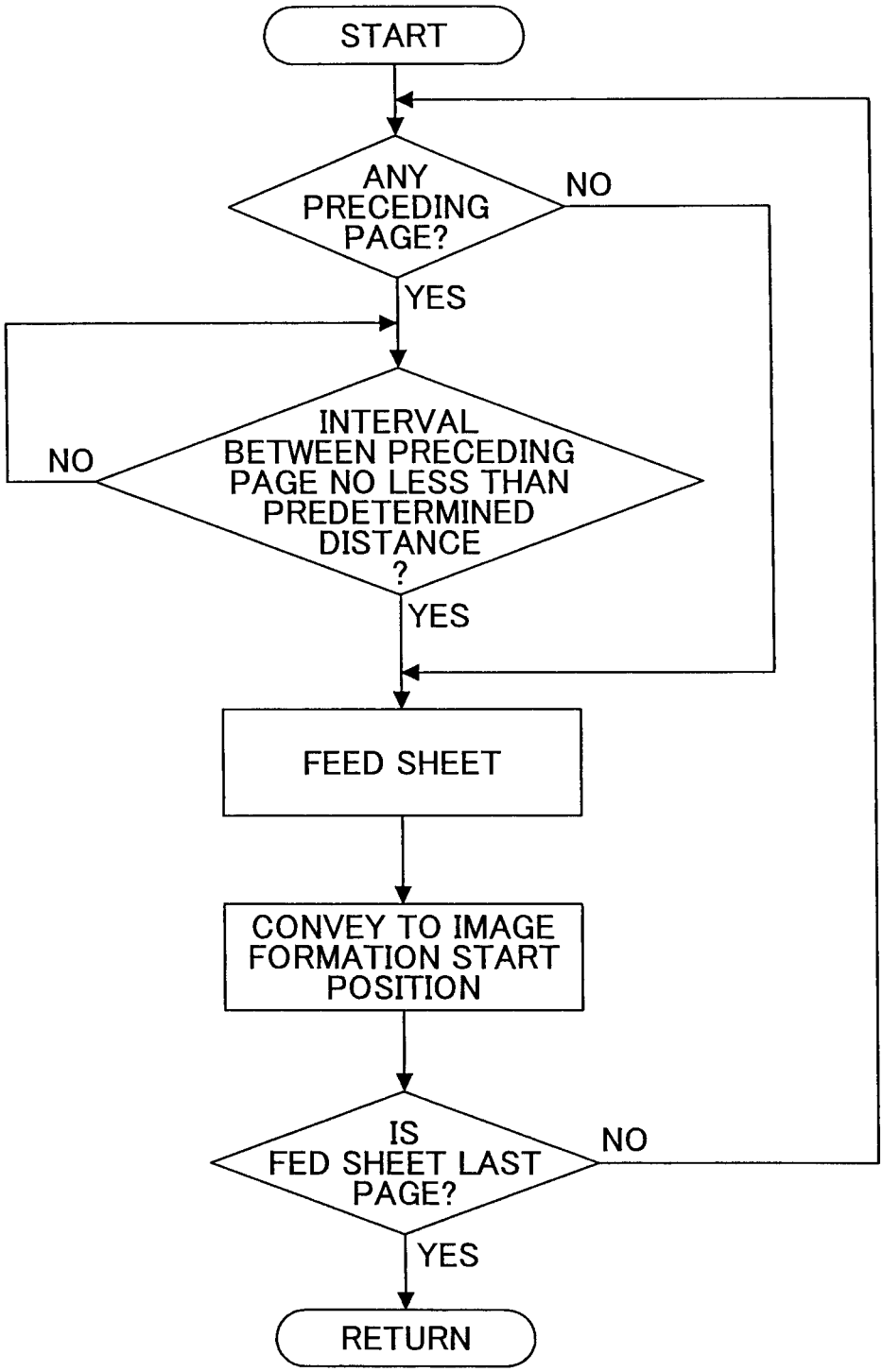
FIG. 6 is a flowchart for describing a sheet-feed process according to an embodiment of the present invention.

As shown in FIG. 6, a sheet-feed process is initiated upon starting an image forming operation according to an embodiment of the present invention. In the sheet-feed process, paper 5 is fed sheet by sheet from the sheet-feed part 4 to an image formation starting position of the sub-scan conveying part 3 by driving the sheet-feed motor 45 and a sheet-feed clutch (not shown). Then, in a case where there is a next sheet of paper 5 (next page) for forming an image, the position of the rear end of a preceding paper 5 (preceding page) is detected by calculating the conveyance distance from a paper end detecting sensor (not shown) to the paper 5. Then, it is determined whether the paper interval with respect to the preceding page has reached a predetermined distance (e.g., 60 mm). When the paper interval reaches the predetermined distance, paper 5 is fed and conveyed to the image formation start position (printing start position). Thereby, paper 5 can be successively fed to the image formation start position of the sub-scan conveying part 3. This sheet-feeding process is repeated until the last page.

Figure 7:
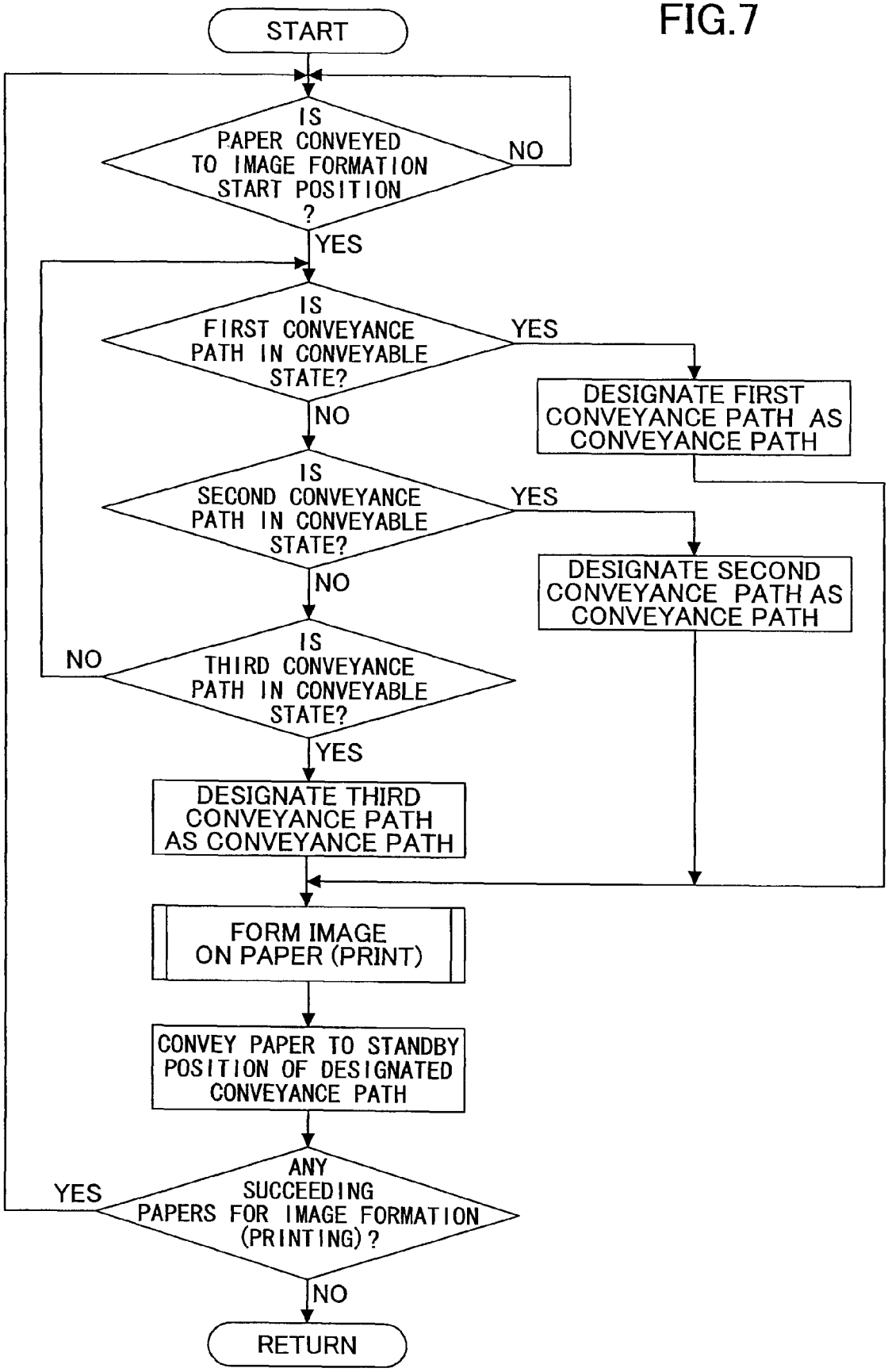
FIG. 7 is a flowchart for describing an image forming process according to an embodiment of the present invention.

Then, an image forming process is initiated when the paper 5 is fed to the image formation start position of the sub-scan conveying part 3 as shown in FIG. 7. In the image forming process, first, it is determined whether there are any preceding papers 5 in the first, second, and third conveyance paths 401*a*, 401*b*, 401*c* or even in a case where there is preceding paper 5 in the first-third conveyance paths 401*a*-401*c*, it is determined whether paper standby (standby process) is completed for the preceding paper 5 in the first-third conveyance paths 401*a*-401*c*. The paper 5 is distributed to the conveyance path 401 (401*a*, 401*b*, 401*c*) having no preceding paper 5 or the conveyance path 401 (401*a*, 401*b*, 401*c*) having completed the standby process. That is, the paper 5 is distributed (conveyed) to the conveyance path 401 (401*a*, 401*b*, 401*c*) which is in a paper conveyable state (available).

For example, in a case where the first conveyance path 401*a* is determined to be in a paper conveyable state, the first conveyance path 401*a* is designated (set) as the destination for conveying the paper 5 (conveyance destination). In a case where the first conveyance path 401*a* is determined to not be in the paper conveyable state, it is determined whether the second conveyance path 401*b* is in a paper conveyable state.

In a case where the second conveyance path 401*b* is determined to be in a paper conveyable state, the second conveyance path 401*b* is designated (set) as the conveyance destination. In a case where the second conveyance path 401*b* is determined not to be in the paper conveyable state, it is determined whether the third conveyance path 401*c* is in a paper conveyable state. In a case where the third conveyance path 401*b* is determined to be in the paper conveyable state, the third paper conveyance path 401*c* is designated (set) as the conveyance destination. In a case where the third conveyance path 401*c* is determined not to be in the paper conveyable state (i.e. none of the first-third conveyance paths 401*a*-401*c* being in the paper conveyable state), the determination steps are repeated until one of the first-third conveyance paths 401*a*-401*c* become the paper conveyable state.

Accordingly, the paper 5 is conveyed to the plural conveyance paths 401 (401*a*, 401*b*, 401*c*) in a prioritized order starting from the first conveyance path 401*a*, the second conveyance path 401*b*, and the third conveyance path 401*c*. Therefore, in a case where conveying of the paper 5 is conducted without executing the standby process (standby mode, described in detail below), the first conveyance path 401*a* is selected as the first conveyance path. In the case where the first conveyance path 401*a* is selected, the conveying distance is shortest. Furthermore, since paper 5 can be conveyed substantially in a straight line to the first conveyance path 401*a*, a relatively firm paper can be conveyed by the first conveyance path 401*a*. Furthermore, according to an embodiment of the present invention, since only the first and second conveyance paths 401*a* and 401*a* are used in a case where the standby time is relatively short, paper 5 can be easily recovered, for example, in a case where jamming of the paper 5 occurs.

Although not shown in the drawings, jamming in the conveyance path 401 according to an embodiment of the present invention is fixed (resolved) by opening the sheet-discharge tray 8. Therefore, the second conveyance path 401*b*, which is situated above the first conveyance path 401*a* and in the vicinity of the sheet-discharge tray 8, is selected as the second priority following the first conveyance path 401*b*.

It is, however, to be noted that the conditions for selecting the conveyance path are not to be limited to the conditions described above. For example, in a case where there is little standby time, the first and second conveyance paths 401*a* and 401*b* may be alternately used, so that a preceding printed paper 5 (preceding paper having an image formed thereon) can be conveyed independently from a succeeding paper 5 to be printed. Particularly, in a case of a shuttle type image forming apparatus which intermittently conveys the paper 5 (i.e. repeats stopping and conveying of paper) during printing, the preceding paper 5 is also stopped and conveyed if the conveyance path is the same as the succeeding paper 5. Thus, in a case where the intermittent conveying is conducted when discharging the paper 5 from the sheet-discharge part 412, the paper 5 may be bent when discharging the paper 5 from the sheet-discharge part 412, to thereby prevent the paper 5 from being satisfactorily discharged.

In this case, the conveyance paths 401 may be switchably used for preventing such problem. That is, the conveyance path for conveying the preceding paper 5 and the conveyance path for conveying the succeeding paper 5 being printed may be switched, so that the preceding paper 5 can be conveyed separately from the succeeding paper 5 being printed. Therefore, the preceding paper 5 can be conveyed to the sheet-discharge part 412 and discharged without being stopped even where the succeeding paper 5 is being printed.

After designating (setting) any one of the first-third conveyance paths 401*a*-401*c* as the conveyance destination in the above-described manner, image forming (printing) is performed on the paper 5 by moving the recording head 24 in the main scanning direction and conveying the paper 5 in the sub-scanning direction. Then, the paper 5 having an image formed thereon is conveyed to a standby position at one of the first-third conveyance paths 401*a*-401*c*. The image forming process is repeated in the above-described manner in a case where there is a succeeding paper 5 to be printed.

Next, the standby process (delay process) is described with reference to FIG. 8. After the image forming process is completed and the printed paper 5 is conveyed to a standby position at one of the first-third conveyance paths 401*a*-401*c*, various setting conditions (e.g., temperature, humidity, type of recording medium, printing mode, size of paper, image data, amount of liquid droplets jetted onto the entire image or a portion (e.g., end part) of the image, mode signal of outside apparatus, mode signal of control panel) are read out. Then, either a standby mode or a normal mode is selected in accordance with the combination of the setting conditions (described in detail below).

According to an embodiment of the present invention, the selection between the standby mode and the normal mode according to various setting conditions can be performed by storing a prepared table indicative of corresponding relationships between one or more setting conditions and the modes (standby mode, normal mode) in the non-volatile memory (NVRAM) 204 and selecting the modes by reading out data (mode selection conditions) from the table. The mode selection conditions stored in the non-volatile memory (NVRAM) 204 may preferably be allowed to be changed according to, for example, a user's input from a control panel of the image forming apparatus 1000 or from a printer driver of an outside apparatus (host side).

In a case where the normal mode is selected, the paper 5 is conveyed to a conveyance destination located at a downstream side (e.g., the conveyance path extending to the sheet-discharge part 412 or the conveyance path extending to the double-side printing unit 10) without stopping.

In a case where the standby mode is selected, the paper 5 is conveyed and stopped at the standby position of the first-third conveyance paths 401*a*-401*c*. Then, a standby time is determined (described in detail below) according to various setting conditions (e.g., temperature, humidity, type of recording medium, printing mode, size of paper, image data, amount of liquid droplet jetted to the entire image or a portion (e.g., end part) of the image, mode signal of outside apparatus, mode signal of control panel). The determination of the standby time according to an embodiment of the present invention can made by storing a prepared table indicative of corresponding relationships between one or more setting conditions and the standby time in the non-volatile memory (NVRAM) 204 and determining the standby time by reading out data (standby time determination conditions) from the table. The standby time determination conditions stored in the non-volatile memory (NVRAM) 204 may preferably be allowed to be changed according to, for example, a user's input from a control panel of the image forming apparatus 1000 or from a printer driver of an outside apparatus (host side).

The paper 5, being assigned the determined standby time, stands by at the standby position until the elapse of the determined standby time. Upon the elapse of the determined standby time, it is determined whether the distance (interval) between the paper 5 and a preceding paper 5 is no less than a predetermined value (e.g., 20 mm). The position of the rear end of the preceding paper 5 is detected by calculating the conveyance distance from a paper end detecting sensor (not shown) to the paper 5. Thereby, even where plural papers 5 are assigned different standby times, disruption of page order (paper order), jamming due to collision with a preceding paper 5, or bending of paper can be prevented.

In a case where the distance between the paper 5 and the preceding paper 5 is no less than the predetermined value or where the paper 5 stands by until the distance with respect to the preceding paper 5 becomes no less than the predetermined value, the paper 5 is released from the standby state and is conveyed to the conveyance destination located at a downstream side (e.g., the conveyance path extending to the sheet-discharge part 412 or the conveyance path extending to the double-side printing unit 10). As described with FIG. 7, upon the release of the standby state of the paper 5, the succeeding paper (next page) 5 corresponding to the same conveyance path is conveyed. Accordingly, the succeeding paper 5 can be conveyed to the conveyance path 401 before the preceding paper 5 is completely conveyed out of the conveyance path 401, to thereby improve productivity.

Next, the standby process is described with reference to FIGS. 9-14. FIGS. 9-14 are schematic diagrams for describing the flow of paper 5 in a case where the standby process is conducted according to an embodiment of the present invention. In the example shown in FIGS. 9-14, the first-third conveyance paths 401*a*-401*c* are used. That is, the paper 5 can be put in a standby state for curl correction or drying of the paper 5 when conveying the paper 5 with the three conveyance paths 401*a*-401*c*. The paths used for the conveyance path 401 are not limited to the three conveyance paths 401*a*-401*c*. For example, in a case where the standby time is relatively short or a case where the number of available conveyance paths is few, a combination of the first conveyance path 401*a* and the second conveyance paths 401*b*, a combination of the first conveyance path 401*a* and the third conveyance path 401*c*, or a combination of the second conveyance path 401*b* and the third conveyance path 401*c* may be used. Thus, the number of conveyance paths may be changed. For example, the conveyance path 401 may be increased to four or more paths for increasing the standby time.

The example shown in FIGS. 9-14 illustrates a case of conveying five sheets of paper 5 (5A, 5B, 5C, 5D, 5E). The conveying part 7 (having the same configuration as that shown in FIG. 4) is provided with standby position sensors 420 for detecting the standby positions of the papers 5. The method of detecting the positions of the papers 5 is not limited to the method of using the standby position sensors 420. For example, the position of the paper 5 may be detected by calculating the conveyance distance from a given sensor (not shown) to the paper 5. In the example shown in FIGS. 9-14, like components (e.g., branching plates 404, 405) and functions of the conveying part 7 described with FIG. 4 are denoted with like reference numerals and are not further explained.

Figure 9:
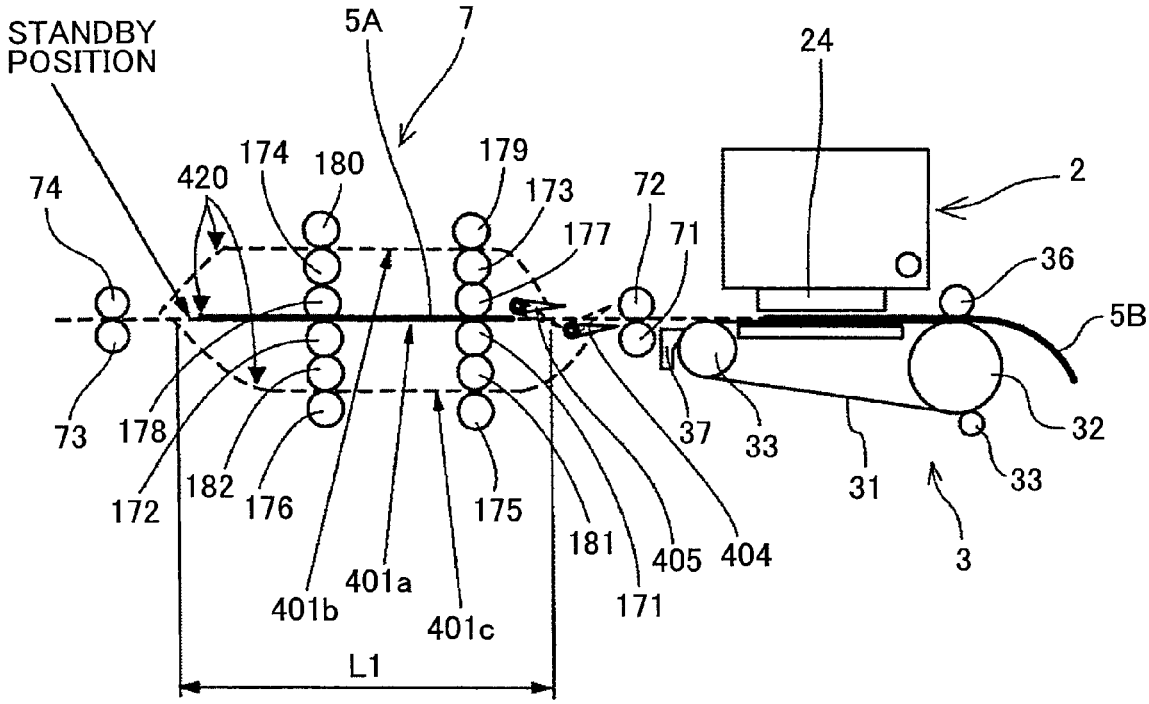
FIG. 9 is a schematic diagram showing the first and second papers during a standby process according to an embodiment of the present invention.

The paper 5A illustrated in FIG. 9 has an image formed thereon by the image forming part 2 and is conveyed to the conveying part 7 by the sub-scan conveying part 3. The conveying part 7 conveys the paper 5A on the first conveyance path 401*a* until the front end of the paper 5A is detected by the standby position sensor 420. That is, upon detection of the front end of the paper 5A, the conveyance of the paper 5A is stopped at the standby position and is placed in the standby state until the standby time elapses. The succeeding paper 5B is stopped at the image formation start position (printing start position). At this stage, since no papers exist in the second and third conveyance paths 401*b*, 401*c*, the second conveyance path 401*b*, based on the above-described determination process, is designated (set) as the conveyance path for conveying the succeeding paper 5B.

Figure 10:
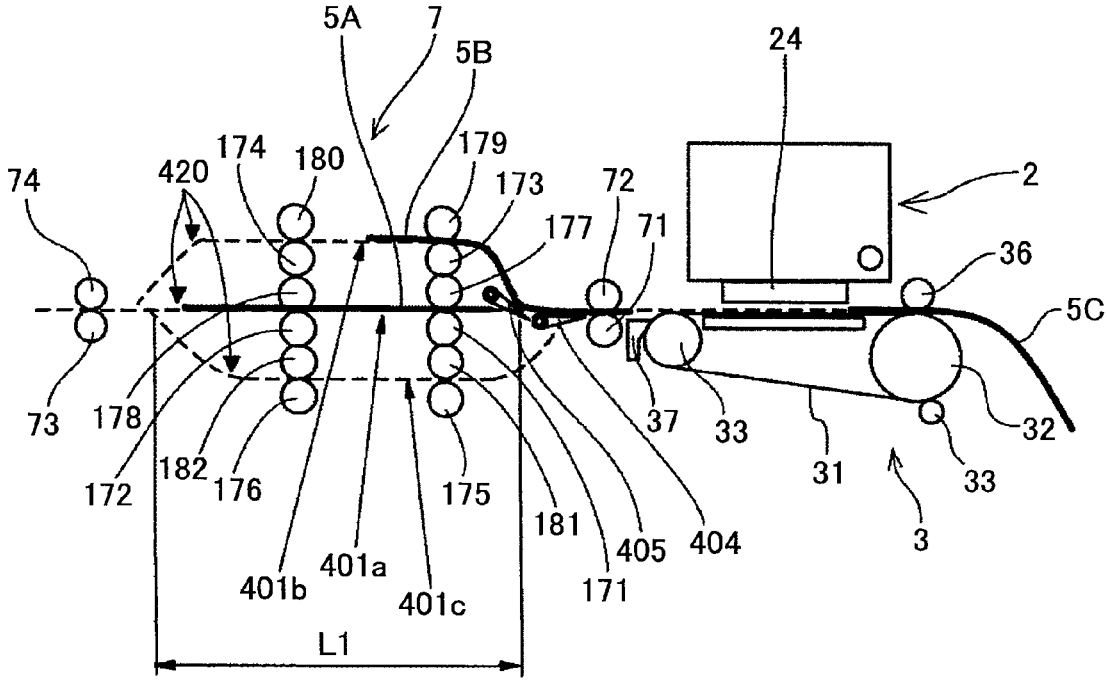
FIG. 10 is a schematic diagram showing the first, second, and third papers subsequent to the state of FIG. 9 during a standby process according to an embodiment of the present invention.

As shown in FIG. 10, the paper 5B is conveyed to the second conveyance path 401*b*. The succeeding paper 5C is conveyed to the image formation start position while maintaining a predetermined distance (paper interval), for example, 60 mm from the preceding paper 5B.

Figure 11:
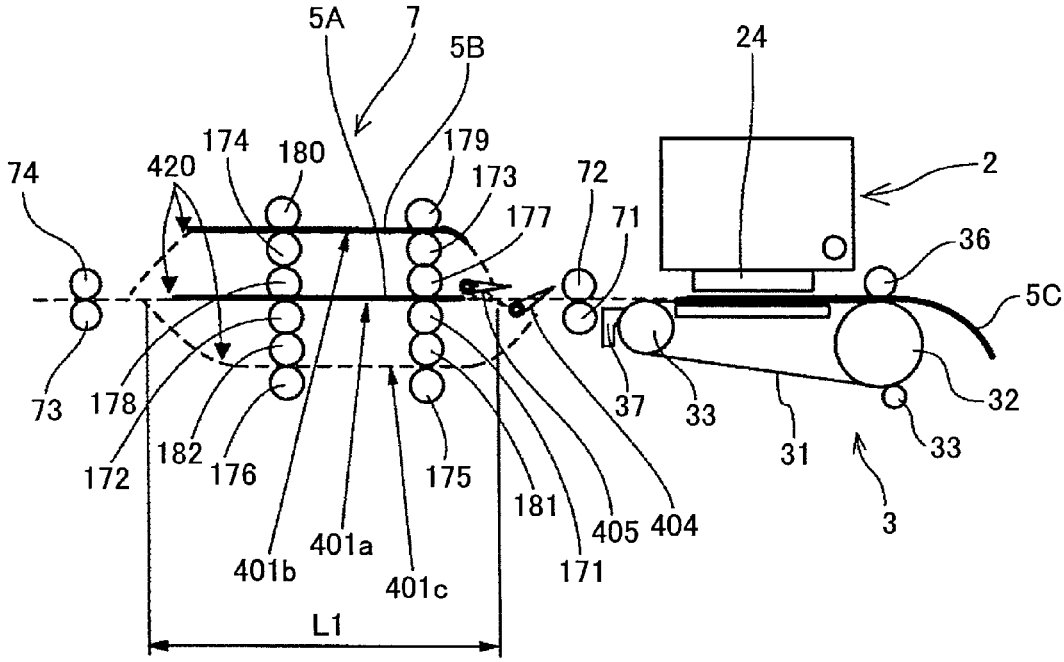
FIG. 11 is a schematic diagram showing the first, second, and third papers subsequent to the state of FIG. 10 during a standby process according to an embodiment of the present invention.

Then, as shown in FIG. 11, the conveying part 7 conveys the paper 5B on the second conveyance path 401*b* until the front end of the paper 5B is detected by the standby position sensor 420. That is, upon detection of the front end of the paper 5B, the conveyance of the paper 5B is stopped at the standby position and is placed in the standby state until the standby time elapses. The succeeding paper 5C is stopped at the image formation start position (printing start position).

Figure 12:
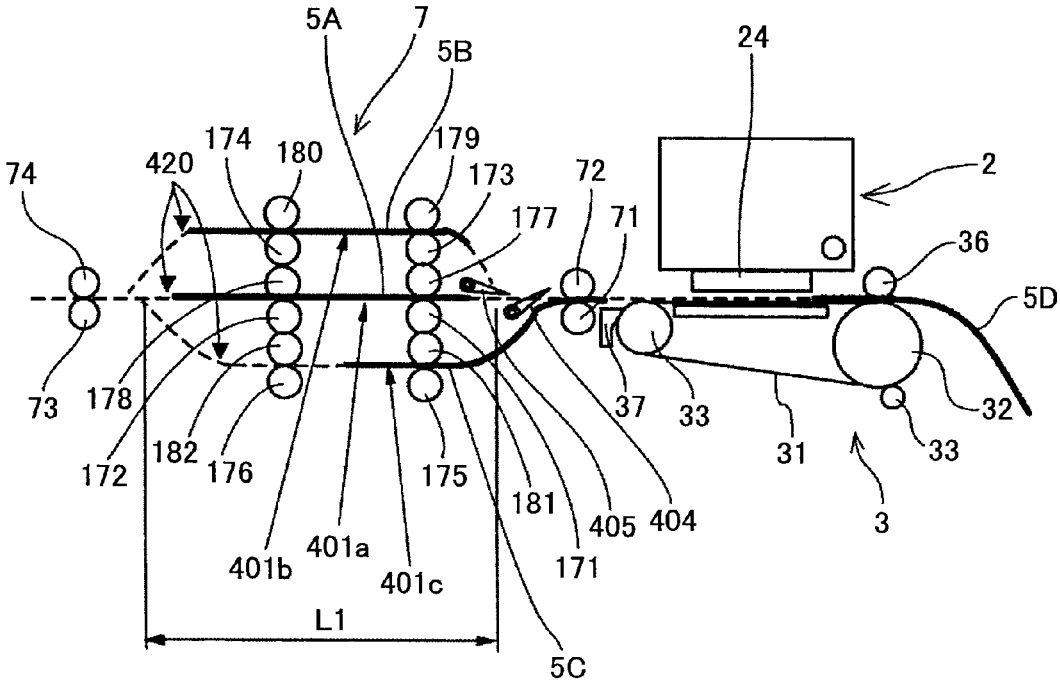
FIG. 12 is a schematic diagram showing the first, second, third, and fourth papers subsequent to the state of FIG. 11 during a standby process according to an embodiment of the present invention.

Then, as shown in FIG. 12, the paper 5C is conveyed to the third conveyance path 401*c*. The succeeding paper 5D is conveyed to the image formation start position while maintaining a predetermined distance (paper interval), for example, 60 mm from the preceding paper 5C.

Figure 13:
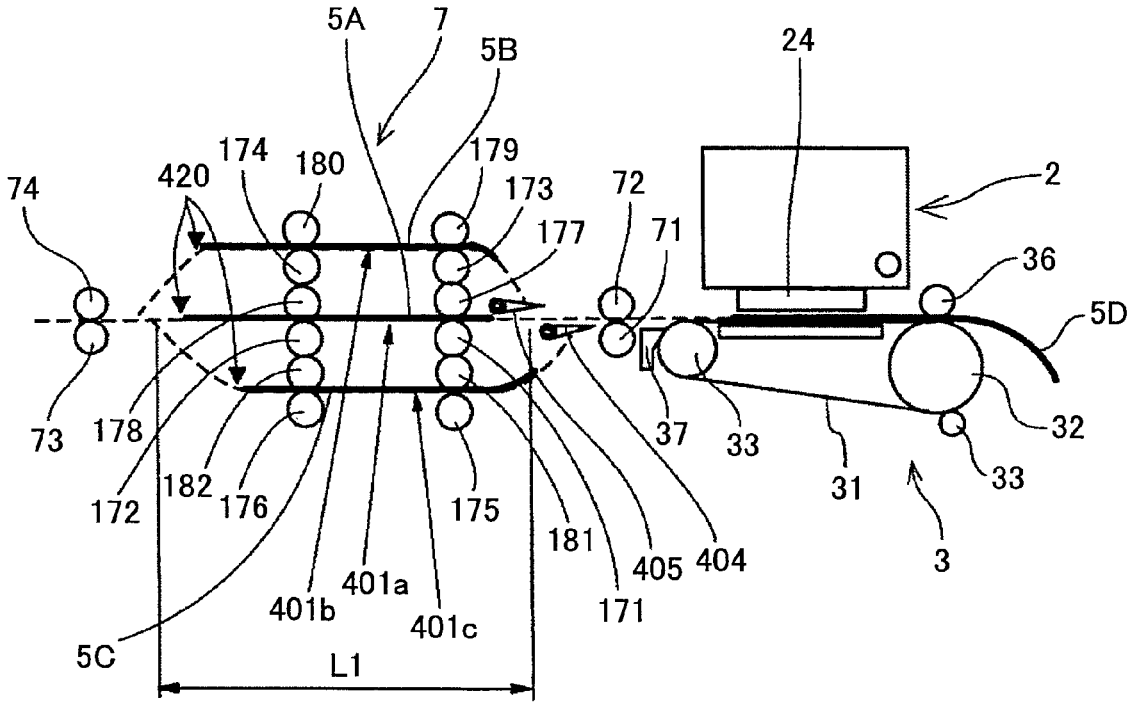
FIG. 13 is a schematic diagram showing the first, second, third, and fourth papers subsequent to the state of FIG. 12 during a standby process according to an embodiment of the present invention.

Then, as shown in FIG. 13, the conveying part 7 conveys the paper 5C on the third conveyance path 401*c* until the front end of the paper 5C is detected by the standby position sensor 420. That is, upon detection of the front end of the paper 5C, the conveyance of the paper 5C is stopped at the standby position and is placed in the standby state until the standby time elapses. The succeeding paper 5D is stopped at the image formation start position (printing start position). At this stage, since the standby positions of the first-third conveyance paths 401*a*-401*c* are occupied by the papers 5A-5C, the image forming process (printing) for the succeeding paper 5D is not started until the standby time of the paper 5A on the first conveyance path 401*a* elapses.

Figure 14:
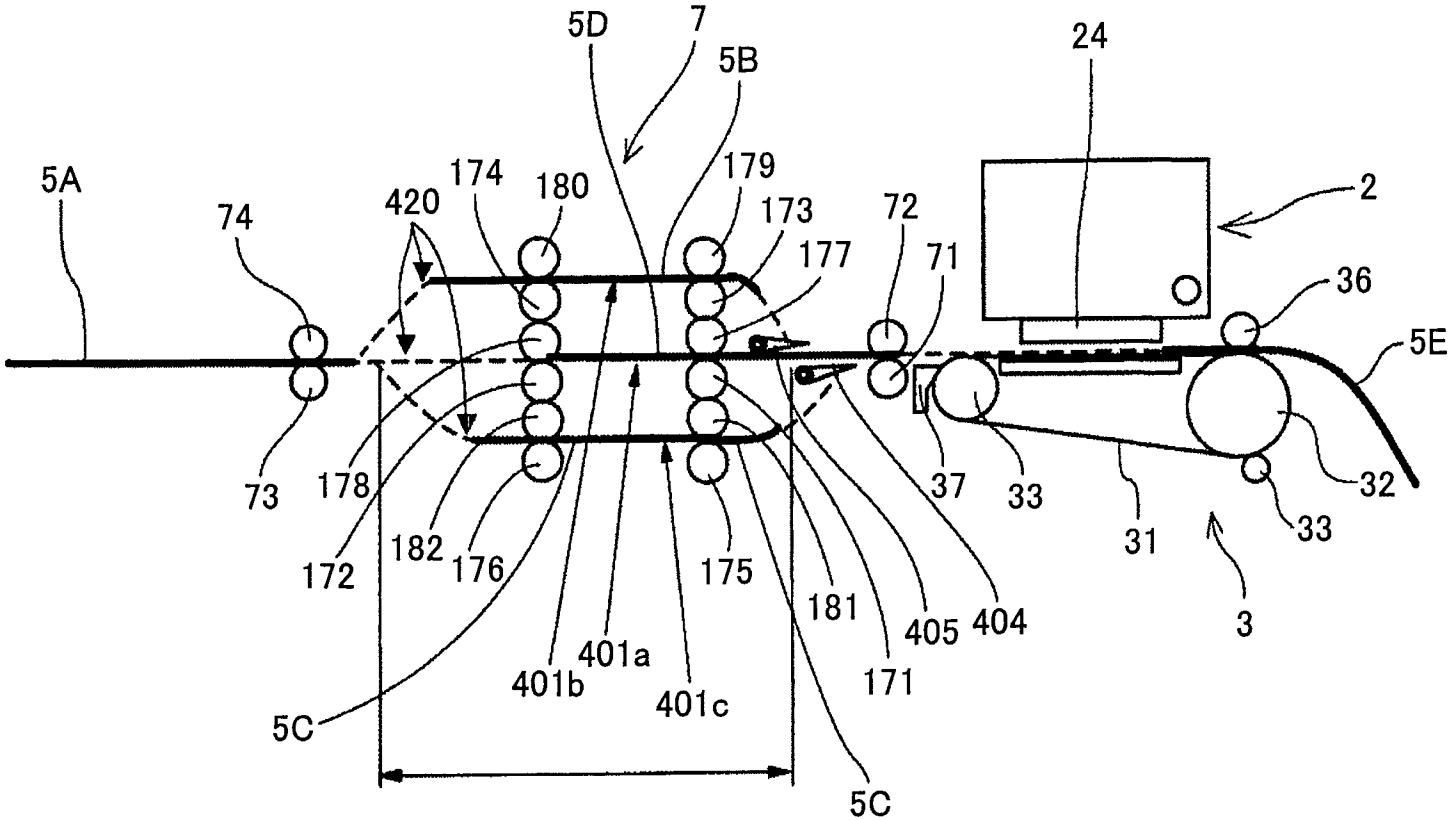
FIG. 14 is a schematic diagram showing the first, second, third, fourth, and fifth papers subsequent to the state of FIG. 13 during a standby process according to an embodiment of the present invention.

Then, as shown in FIG. 14, the paper 5A on the first conveyance path 401*a* is conveyed to the sheet-discharge part 412 or the double-side printing unit 10 when the standby time of the paper 5A elapses. At substantially the same time, the image forming process (printing) is performed on the paper 5D by the image forming part 2 as the paper 5D is conveyed by the sub-scan conveying part 3. Then, the printed paper 5D is conveyed to the first conveyance path 401*a* and stopped at the standby position of the first conveyance path 401*a*. The succeeding paper 5E is conveyed to the image formation start position while maintaining a predetermined distance (paper interval), for example, 60 mm from the preceding paper 5D. The processes thereafter are conducted by repeating the processes described with FIGS. 9-14.

Next, the various setting conditions used for switching between the standby mode and the normal mode and for determining the standby time are described with reference to FIG. 8.

For example, the control part 200 detects temperature and humidity by reading out a detection signal from the temperature/humidity sensor provided in at least one of the sensors S1, S2, S3 illustrated in FIG. 1. For example, in a low temperature/low humidity environment where the type of paper 5 is plain paper, curling of the paper 5 easily occurs since the paper 5 is dry. Therefore, the conditions for selecting the standby mode increase in such an environment. Furthermore, in the case where the standby mode is selected, a relatively long time is determined as the standby time. Nevertheless, the above-described relationship between temperature/humidity and the standby time is merely an example and may differ depending on other conditions such as type of paper.

Next, the control part 200 reads out data regarding the type of recording medium (paper 5). For example, data regarding the type of paper 5 may be input from a control panel of the image forming apparatus 1000 by the user of the image forming apparatus 1000 or a printer driver of an outside apparatus (host side). Furthermore, the type of paper 5 may also be automatically detected. For example, in a case where the paper 5 is a type that easily curls (e.g., thin paper), the standby mode is selected, and a relatively long time is determined as the standby time. On the other hand, in a case of using a relatively firm paper that is resistant to curling, the conditions for selecting the normal mode increase.

Then, the control part 200 reads out the printing mode. The printing mode includes, for example, a high grade printing mode in which image quality has a relatively higher priority than printing speed or a high speed printing mode in which printing speed has a relatively higher priority than image quality. The printing mode is, for example, input from a printing driver of an outside apparatus (host side) by the user. In the high grade printing mode, the paper 5 remains inside the image forming apparatus for a relatively long time (substantially equivalent to standby time) since an image is formed by overlapping plural images on the paper 5. Therefore, in the case of a high grade printing mode, the conditions for selecting the normal mode increase. Furthermore, in a case where the standby mode is selected in the high grade printing mode, a relatively short time is determined as the standby time.

Then, the control part 200 reads out the size of paper 5 (paper size). For example, data regarding the paper size may be input from a control panel of the image forming apparatus 1000 by the user of the image forming apparatus 1000 or a printer driver of an outside apparatus (host side). In this example, the "size of paper (paper size)" includes not only the actual size of the paper 5 but also includes the conveying direction (orientation) of the paper 5 (e.g., A4 size horizontal paper, A4 size vertical paper). For example, in a case where the paper size (length) of the paper 5 is greater than the length of the conveyance path (L1 in FIG. 9), the normal mode is selected. However, even in a case where the paper size (length) of the paper 5 is greater than the length of the conveyance path, the paper 5 may be put in a standby state where necessary by using the first conveyance path 401*a* and the sheet-discharge conveyance path 70. In the case where the paper 5 is put in the standby state, the succeeding paper 5 is also put in a standby state.

Figure 15A:
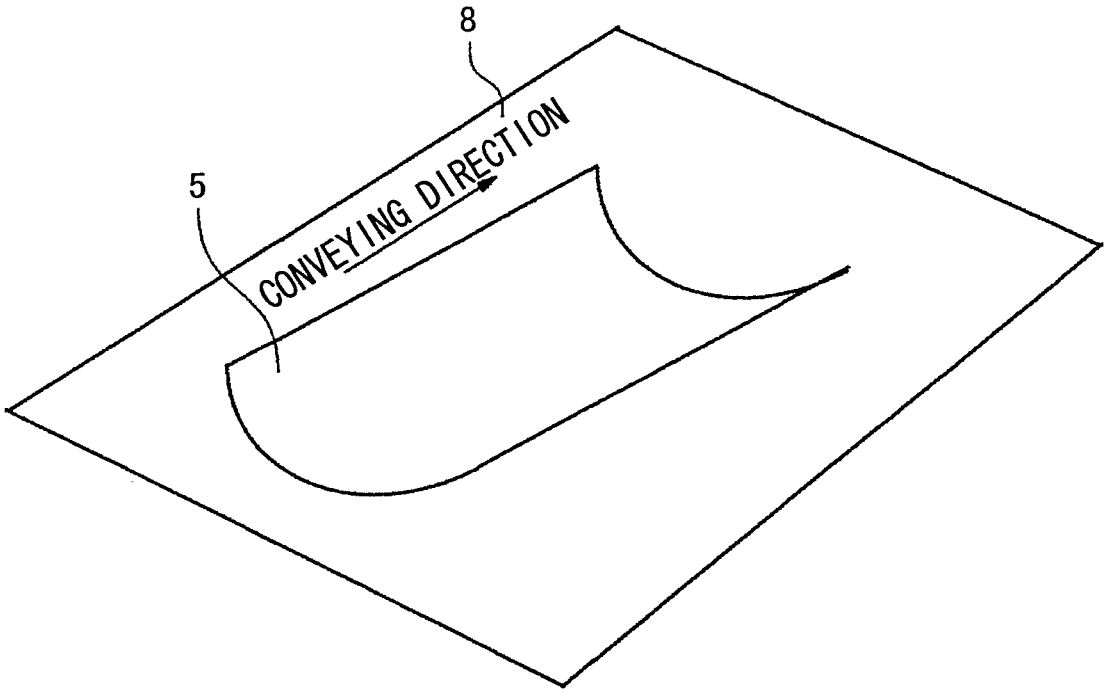
FIGS. 15A and 15B are perspective views for describing curling of paper.
Figure 15B:
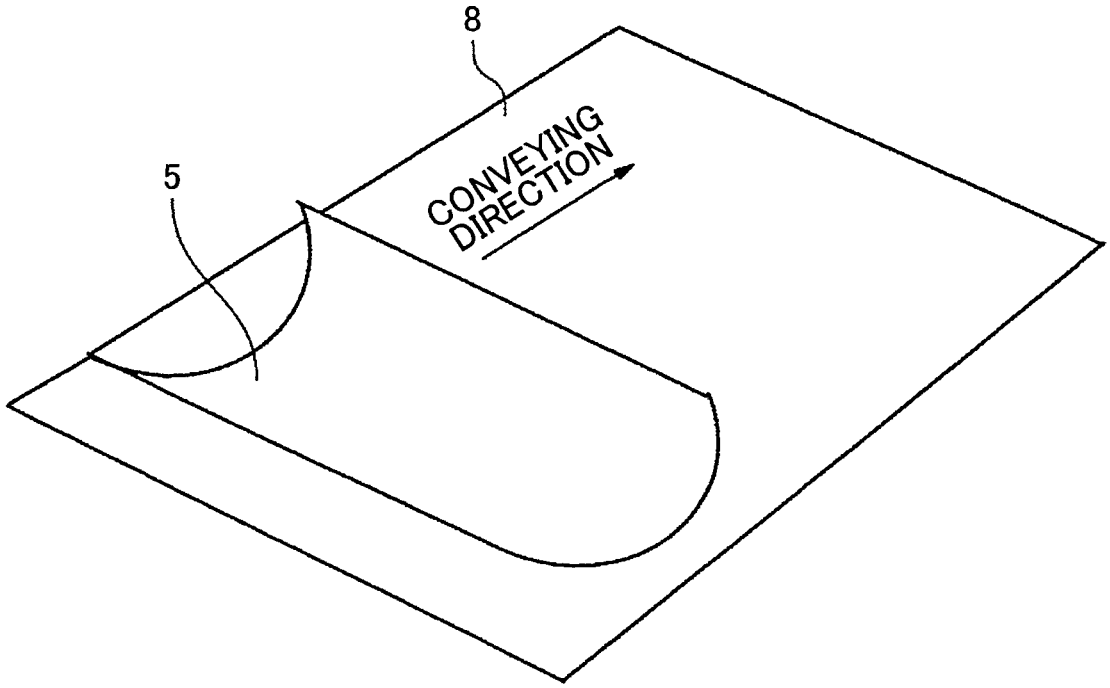

The conveying direction of the paper and the curling property of the paper 5 are described in detail with reference to FIGS. 15A and 15B. FIGS. 15A and 15B are schematic diagrams showing a curled sheet of paper 5 discharged onto the sheet-discharge tray 8. More specifically, FIG. 15A shows a discharged A4 size paper in a vertical state (A4 size vertical paper), and FIG. 15B shows a discharged A4 size paper in a horizontal state (A4 size horizontal paper). The direction in which the curling occurs differs 90 degrees between a paper 5 being in a vertical state and a horizontal state. For example, in a case of an A4 size horizontal paper 5, the paper 5 curls in a direction that is perpendicular to the conveying direction (sheet-discharge direction) as shown in FIG. 15B. In such a case, a succeeding discharged paper 5 may push away the preceding curled paper 5 discharged onto the sheet-discharge tray 8, to thereby cause difficulty in stacking the discharged papers 5 on the sheet-discharge tray 8. Therefore, in such a case where the paper 5 curls in a direction perpendicular to the conveying direction (as shown in FIG. 15B), the conditions for selecting the standby mode increase. Furthermore, in a case where the standby mode is selected, a relatively long time is determined as the standby time.

It is to be noted that the curling direction of the paper 5 is not limited only to the vertical direction and the horizontal direction as described with the A4 size paper. The above-described curling of the A4 size horizontal and vertical paper is merely used as a common example considering the vast amount of A4 size distributed in the paper market. The curling direction may vary depending on, for example, the orientation of the arrangement of the fibers of the paper 5. More specifically, since the paper 5 expands in a direction perpendicular to the orientation of the arrangement of fibers of the paper 5, the paper 5 curls in a direction perpendicular to the orientation of the arrangement of fibers of the paper 5.

Then, the control part 200 reads out the image data to be formed (printed) on the paper 5. The image data may be read out, for example, from an outside apparatus (host side) or data read by the image reading part 11. Furthermore, the image data may be read out before or after performing an image forming process (printing process) on the paper 5. In this example, the standby mode or the normal mode is selected by determining the area (size) in which the image data are formed (printed) on the paper 5 and the distribution of image data formed (printed) on the paper 5. The greater the area of the printed image data or the greater the distribution of the printed image data, the more likely the paper 5 is curled. Furthermore, in such a case of selecting the standby mode where the curling is likely to occur, a relatively long time is determined as the standby time. However, the relationship between the standby time and the area (size) of image data printed on the paper 5 or the distribution of image data printed on the paper 5 is not limited to the above-described example. For example, the relationship with respect to standby time may significantly vary according to the distribution of image data printed on the paper 5.

Accordingly, by being able to determine whether to select the standby mode based on image data, the necessity of printing in the standby mode can be determined before actually jetting liquid (e.g., recording liquid) droplets to the paper 5.

Then, the control part 200 reads out the amount of recording liquid (liquid droplet jet amount) jetted from the recording head 24. According to an embodiment of the present invention, the image forming apparatus 1000 obtains the liquid droplet jet amount by counting the number of liquid droplets jetted from the recording head 24. After the printing process is finished, the control part 200 determines whether to select the standby mode based on the amount of liquid jetted onto the rear end of the paper (recording medium) 5.

For example, in a case of determining whether to select the standby mode based on the liquid droplet amount with respect to the entire area of the paper (i.e. averaged droplet count per a single sheet of paper=page coverage rate) where the length of time from printing to sheet-discharge becomes relatively shorter and the printed area is concentrated at the rear end of the paper 5 (i.e. a case where page coverage rate increases, a case where amount of liquid adhered to the paper 5 increases), it becomes difficult to correctly determine curling at the rear end of the paper 5. This results in the risk of inadequate stacking of paper 5.

On the other hand, according to an embodiment of the present invention, the problem of inadequate stacking of paper 5 can be prevented by determining whether to select the standby mode based on the amount of droplets jetted onto the rear end part of the paper 5. It is, however, to be noted that the determination of the selection of the standby mode may be based on parts of the paper other than the rear end part of the paper 5. For example, the determination may be based on the amount of droplets jetted onto a center part of the paper 5 in a case where data are printed only onto the center part of the paper 5. Furthermore, the standby mode or the standby time may also be determined based on the amount of droplets jetted onto other end parts likely to cause curling. As another example, the standby mode may be determined based on the amount of droplets jetted onto the entire area of the paper 5 and the rear end part of the paper 5. More specifically, first, the average number of droplets per square of an entire paper 5 (AVE 1) is obtained from the amount droplets jetted onto the entire paper 5, and the average number of droplets per square of a rear end part of the paper 5 (AVE 2) is obtained from the amount of droplets jetted onto the rear end part of the paper 5 (e.g., an area 50 mm in the sub-scanning direction at the rear end part of the paper 5). The greater one of the average number of droplets AVE1 and AVE2 is assumed as the page coverage rate of the paper 5. Based on the assumed page coverage rate, it is determined whether to select the standby mode.

Accordingly, compared to determining whether to select the standby mode based on either one of the amount of droplets jetted to the entire paper or the amount of the droplets jetted to the rear end part of the paper, the standby mode can be selected with more precision.

Figure 8:
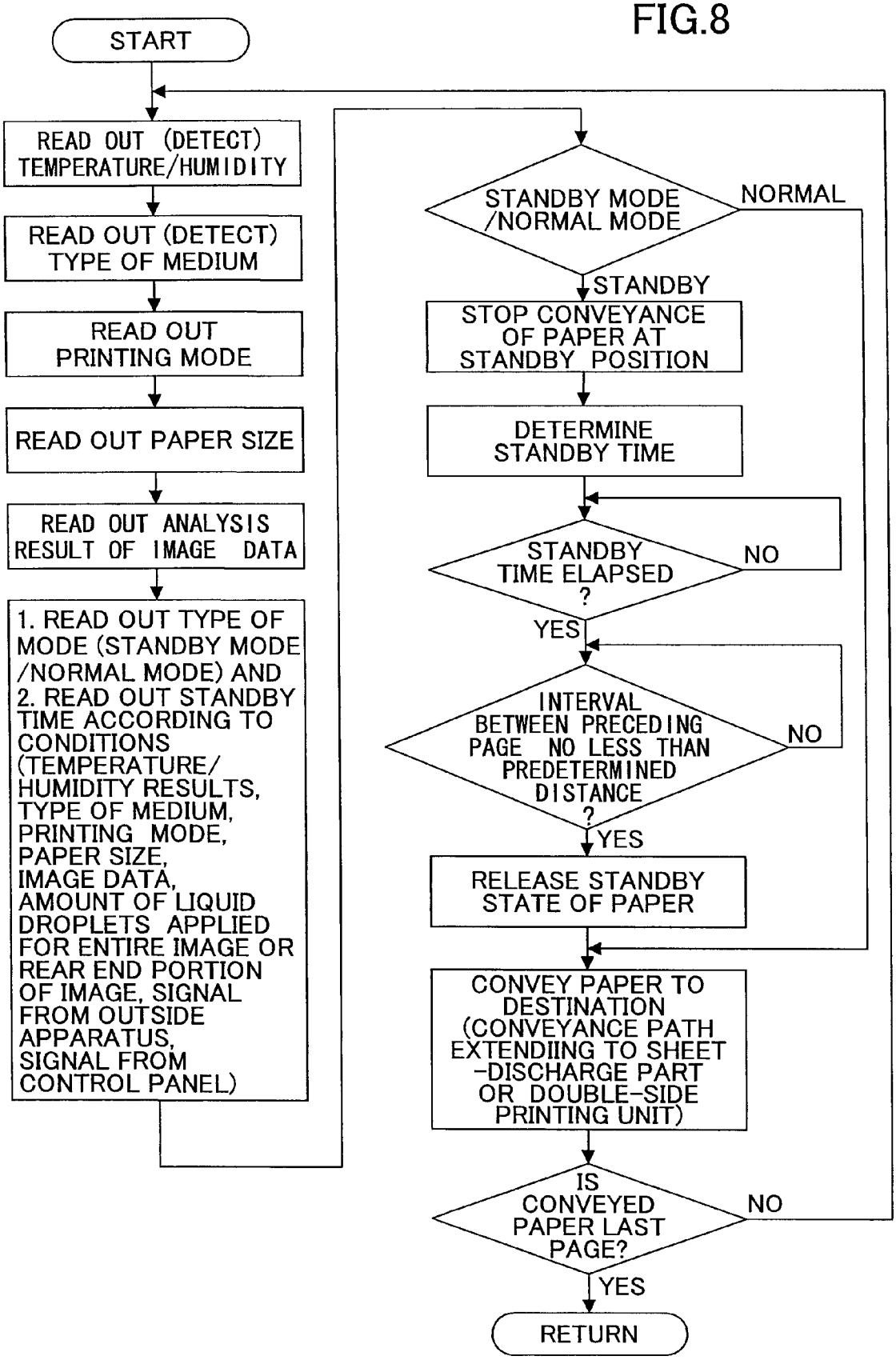
FIG. 8 is a flowchart for describing a standby process (delay process) according to an embodiment of the present invention.

Then, as shown in FIG. 8, after the standby mode is selected, the standby time (i.e. time for the curled paper 5 to be corrected or time for the curled paper 5 to become dry) is determined based on the above-described setting conditions. In other words, since the time for the curled paper 5 to be corrected or the time for the curled paper 5 to become dry vary depending on the above-described setting conditions, the standby time is determined in correspondence with the various setting conditions. Thereby, standby time can be controlled to be a minimum amount so that the standby time does not reduce productivity. As described above, since the relationships between one or more setting conditions (e.g., temperature/humidity, liquid droplet jet amount, type of recording medium, printing mode, paper size, image data, amount of recording liquid) and the standby time are stored beforehand in the form of a table in the non-volatile memory (NVRAM) 204, determining whether to select the standby mode and determining the standby time can be conducted by referring to the table stored in the NVRAM 204.

Next, an example of a method of determining whether to select the standby mode and determining the standby time based on a signal(s) from an outside apparatus or a signal(s) from a control panel of the image forming apparatus 1000 is described. In this example, the signals may be input from a control panel of the image forming apparatus 1000 by the user of the image forming apparatus 1000 or from a printer driver of an outside apparatus (host side).

In one exemplary case of a user who usually prints only a few pages, the user selects (inputs) a normal mode (non-standby mode) setting if printing speed has a higher priority over discharged sheet stacking performance for the user. In a case where the control panel also has a setting for a high speed mode that provides a shortened standby time, the user selects (inputs) the high speed mode. In another exemplary case of a user using plain paper that is curl resistant, the user selects (inputs) a normal mode (non-standby mode) setting. Likewise, in a case where the control panel also has a setting for a high speed mode that provides a shortened standby time, the user selects (inputs) the high speed mode. Furthermore, the settings selected by the user may individually be stored in the non-volatile memory (NVRAM) 204, so that the selection of the standby mode and the standby time can be determined by reading out the conditions for each user.

By providing a part for switching between the standby mode and the normal mode (switching part), the conditions requiring no delay (standby) can be selected and paper can be conveyed without delay control (standby control). Thereby, decrease in productivity due to delay can be controlled to be a minimum amount. Furthermore, in a case where conditions unsuitable for the standby mode are selected as the setting conditions, the standby mode can be cancelled, to thereby prevent jamming of paper or bending of paper.

By being able to switch between the standby mode and the normal mode based on the above-described setting conditions, the curling correction time and the drying time can be anticipated according to the setting conditions. Accordingly, based on the anticipated time, it can be determined whether the mode should be switched to the normal mode or the standby mode. In a case where switching to the standby mode is unnecessary, the paper 5 can be conveyed without being put in a standby state (delay). This minimizes decrease of productivity due to time delay.

Furthermore, by selecting one or more of the plural conveyance paths according to a conveyance delay time (including a case of conveying without any delay), decrease of productivity due to time delay can be minimized by selecting the conveyance path with the shortest conveyance distance (i.e. shortest conveying time). For example, in a case where the conveyance delay time is zero or extremely minute, a single conveyance path is used. In a case where, for example, the conveyance delay time is relatively short, papers are successively conveyed by using two conveyance paths. In a case where, for example, the conveyance delay time is relatively long, papers are successively conveyed by using three conveyance paths With the above-described image forming apparatus having the conveying apparatus and the liquid jetting apparatus according to an embodiment of the present invention, by using a non-contact type image forming method, images can be formed on a large variety of papers. Furthermore, image quality can be improved by being able to jet liquid droplets with high precision and form dots of fine size. Furthermore, both productivity and drying can be improved. Furthermore, energy savings and cost reduction can be achieved.

Hence, according to the above-described embodiments of the present invention, the conveying apparatus includes plural conveyance paths which are arranged in parallel and configured to receive a plurality of conveyance objects fed from an upstream side of the plural conveyance paths and convey the received plural conveyance objects to a conveyance destination situated at a downstream side of the plural conveyance paths, wherein the plural conveyance paths are configured to convey the plural conveyance objects in the order in which the plural conveyance objects are received. Thereby, with the simple configuration of the conveying apparatus, curling and staining of the conveyance object can be prevented while minimizing reduction of productivity.

Furthermore, the conveying apparatus is provided with a delaying part for delaying the timing of conveying the plural conveyance objects for each of the plural conveyance paths by temporarily stopping the reception of the plural conveyance objects or reducing the rate of conveying the plural conveyance objects. This configuration enables switching of conveyance paths among the plural conveyance paths so that the conveyance of a preceding conveyance object and a succeeding conveyance object does not affect one another. That is, a preceding conveyance object and a succeeding conveyance object can be conveyed independent from each other. Thereby, the preceding conveyance object can be, for example, stopped, delayed, or have its conveyance rate controlled while continuing to receive the succeeding conveyance objects. By delaying the conveyance of the preceding conveyance object while receiving the succeeding conveyance object, the conveyance of the conveyance object can be delayed to acquire time for the conveyance object to dry while minimizing reduction of productivity due to the delay.

Next, a conveying apparatus 7A according to a second embodiment of the present invention is described with reference to FIG. 16. In the second embodiment of the present invention, like components are denoted with like reference numerals as of the first embodiment of the present invention and are not further explained.

Among the first-third conveyance paths 401*a*-401*c* included in the conveyance path 401, the first conveyance path (straight conveyance path) 401*a* is provided as the uppermost conveyance path according to the second embodiment of the present invention. This facilitates the fixing of jamming in the first conveyance path (most frequently used conveyance path among the conveyance paths) 401*a*.

Furthermore, the sheet-discharge part 412 according to the second embodiment of the present invention has a sheet-discharge conveyance path 70 including a first sheet-discharge conveyance path 70*a*, a second sheet-discharge conveyance path 70*b*, and a third sheet-discharge conveyance path 70*c*.

The sheet discharge part 412 according to the second embodiment of the present invention includes: a pair of conveying rollers 73 and 74; a first branching plate 406; a second branching plate 60; a third branching plate 407; a fourth branching plate 408; plural sheet-discharge conveying rollers 78, 82, and 86; plural spurs 76, 80, 84 facing the plural sheet-discharge conveying rollers 78, 82, and 86, respectively; a pair of sheet-discharge rollers 77 and 79; and a pair of straight sheet-discharge rollers 410 and 411. The pair of conveying rollers 73 and 74 are configured to convey the paper 5 to the sheet-discharge conveyance path 70, the double-side printing unit 10, or the straight sheet-discharge tray 409. It is preferable to use a spur as the conveying roller 74. The first branching plate 406 is oscillatable between a position illustrated with broken lines and a position illustrated with solid lines in FIG. 16. The first branching plate 406 is configured to switch between the sheet-discharge conveyance path 70, the conveyance path extending to the double-side printing unit 10 (vertical double-side printing conveyance path 90*c*), and the conveyance path extending to the straight sheet-discharge tray 409. The second branching plate 409 is oscillatable between a position illustrated with broken lines and a position illustrated with solid lines in FIG. 16. The second branching plate 409 is configured to switch between the conveyance path extending to the double-side printing unit 10 (vertical double-side printing conveyance path 90*c*) and the conveyance path extending to the straight sheet-discharge tray 409. The third and fourth branching plates 407 and 408 are oscillatable between a position illustrated with broken lines and a position illustrated with solid lines in FIG. 16. The third and fourth branching plates 407 and 408 are configured to switch between the first-third sheet-discharge conveyance paths 70*a*-70*c*. The plural sheet-discharge conveying rollers 78, 82, 86 and the plural spurs 76, 80, 84 are configured to hold the paper 5 and convey the paper 5. The pair of sheet-discharge rollers 77 and 79 is configured to convey the paper 5 to the sheet-discharge tray 8. It is preferable to use a spur as the sheet-discharge roller 79. The pair of straight sheet-discharge rollers 410 and 411 is configured to convey the paper 5 to the straight sheet-discharge tray 409.

The third branching plate 407 is oscillatable between the side of the first and second sheet-discharge conveyance paths 70*a*, 70*b* (illustrated with solid lines in FIG. 16) and the side of the third sheet-discharge conveyance path 70*c* (illustrated with broken lines in FIG. 16) for switching between the first-third sheet-discharge conveyance paths 70*a*-70*c*. In a case where the third branching plate 407 is in the position illustrated with solid lines, the paper 5 is guided to the side where the sheet-discharge conveying rollers 78, 86, and the spurs 76, 84 are provided. In a case where the third branching plate 407 is in the position illustrated with broken lines, the paper 5 is guided to the side where the sheet-discharge conveying roller 82 and the spur 80 are provided.

The fourth branching plate 408 is oscillatable between the side of the first sheet-discharge conveyance path 70*a* (illustrated with solid lines in FIG. 16) and the side of the second sheet-discharge conveyance path 70*b* (illustrated with broken lines in FIG. 16) for switching between the first sheet-discharge conveyance path 70*a* and the second sheet-discharge conveyance path 70*b*. In a case where the fourth branching plate 408 is in the position illustrated with solid lines, the paper 5 is guided to the side where the sheet-discharge conveying rollers 86 and the spur 84 are provided. In a case where the fourth branching plate 408 is in the position illustrated with broken lines, the paper 5 is guided to the side where the sheet-discharge conveying roller 78 and the spur 76 are provided.

Figure 16:
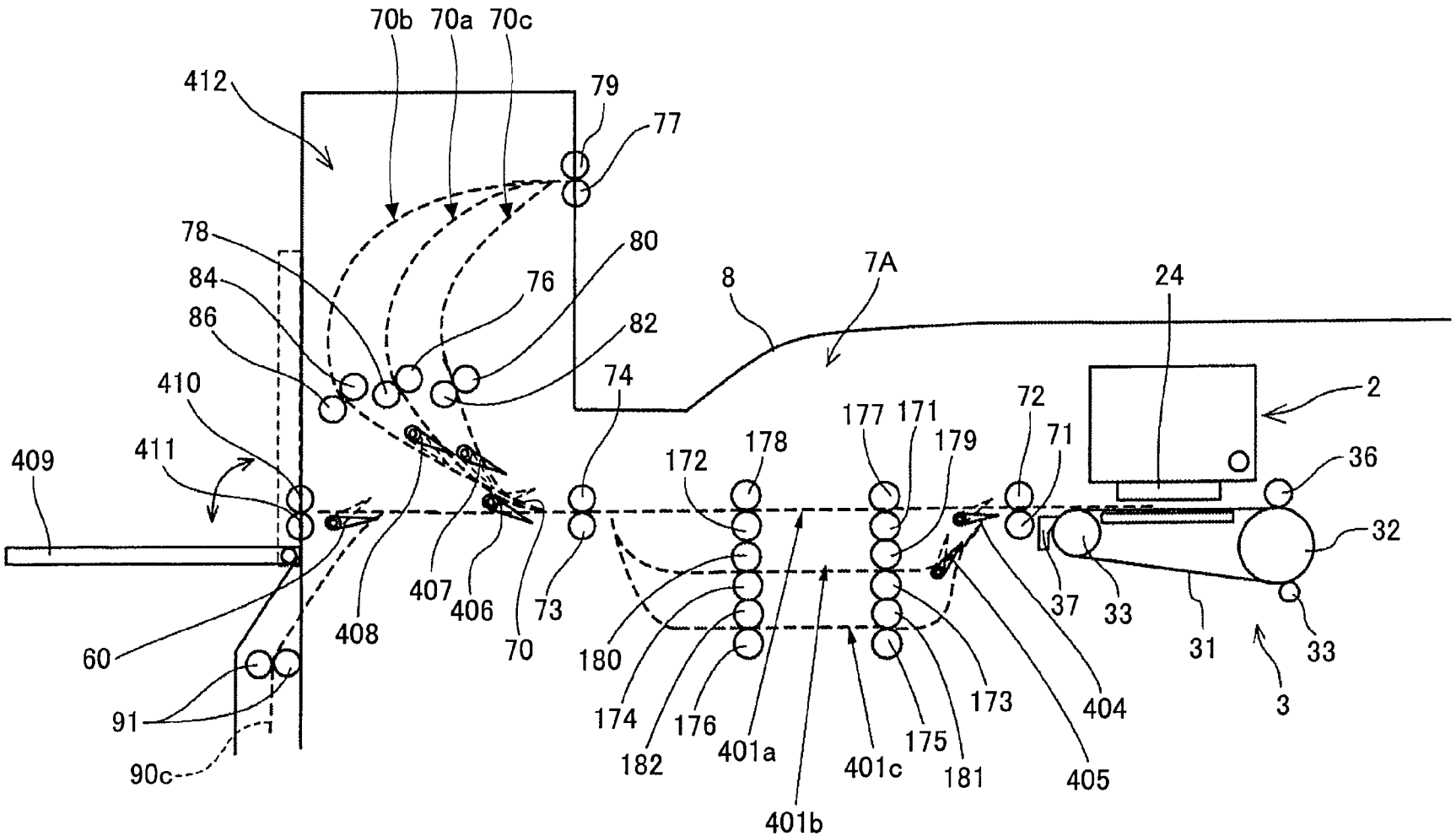
FIG. 16 is a schematic diagram showing a conveying apparatus according to a second embodiment of the present invention.

Furthermore, as shown in FIG. 16, the first-third sheet-discharge conveying paths (standby paths) 70*a*-70*c* are configured as arcuate turning paths and are curved in a direction opposite to that of the curled A4 size horizontal paper shown in FIG. 15B. That is, the standby paths 70*a*-70*c* act as an uncurler for uncurling the curled paper 5. By putting the paper 5 in a standby state at the standby paths, the standby time of the paper 5 can be shortened. Thereby, productivity can be improved. It is to be noted that the arrangement of the sheet-discharge conveyance paths and the number of conveyor rollers and spurs are not limited to those described in FIG. 16. That is, the sheet-conveyance paths, conveyor rollers, and spurs may be provided in greater or fewer numbers than those shown in FIG. 16. Furthermore, the advantages of the standby paths 70*a*-70*c* acting as uncurlers may be attained for not only for A4 size horizontal paper but for other types of paper. For example, in a case where the paper 5 is A4 size vertical paper, the standby paths 70*a*-70*c* may be curved in a direction perpendicular to the curled direction of the paper, so that the paper 5 can standby at the standby paths 70*a*-70*c* having its curl stretched (flattened out). Thereby, the time of standby can be reduced, and productivity can be improved. It is to be noted that the standby process conducted with the first-third sheet-discharge conveyance paths (standby paths) 70*a*-70*c* are the same as that described in the first embodiment of the present invention. Accordingly, further explanation of the standby process with the first-third sheet-discharge conveyance paths (standby paths) 70*a*-70*c* is omitted.

Hence, by using the arcuate turning parts as the branched conveyance paths for standby, the image forming apparatus 1000 can be formed in a smaller size. In addition, since the paper 5 is bent when in a standby state, the curling of the paper 5 can be corrected more efficiently. Thereby, the time for correcting the curled paper 5 can be minimized.

Figure 17:
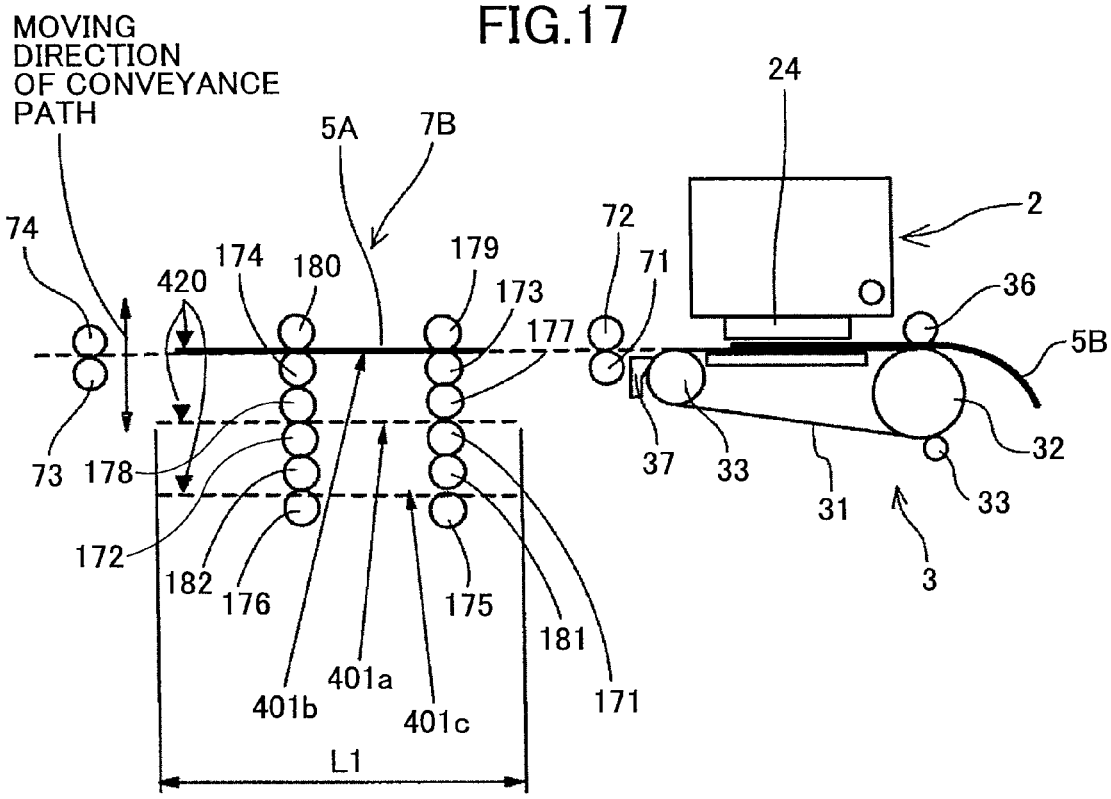
FIG. 17 is a schematic diagram showing a conveying apparatus according to a third embodiment of the present invention.
Figure 18:
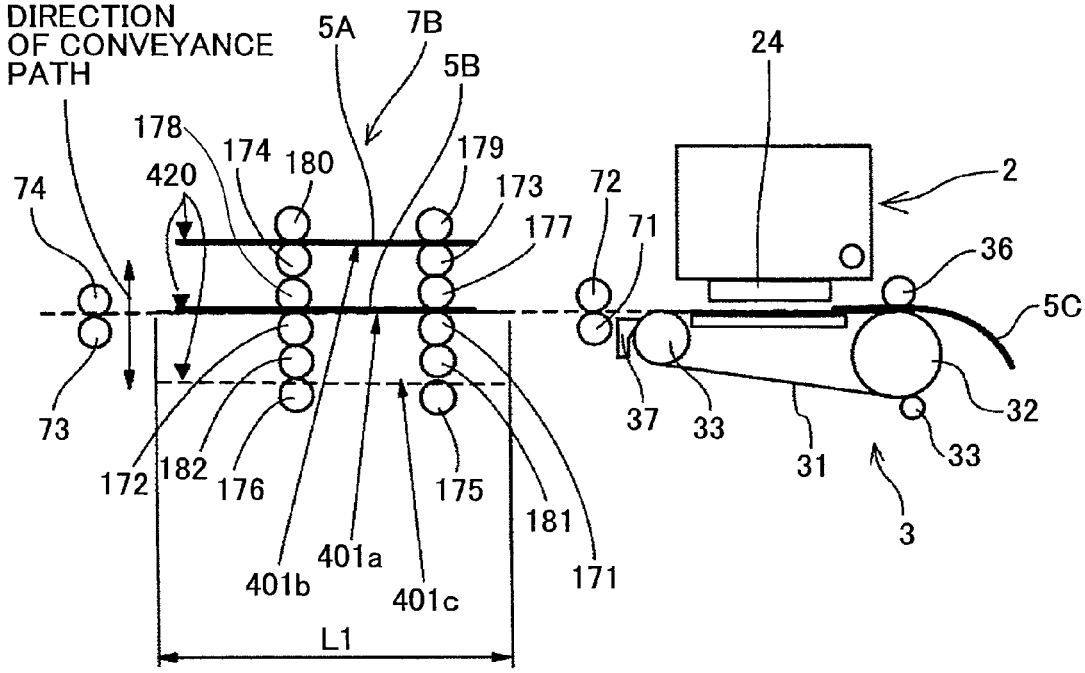
FIG. 18 is a schematic diagram for describing an operation by the conveying apparatus according to the third embodiment of the present invention.

Next, a conveying apparatus 7B according to a third embodiment of the present invention is described with reference to FIGS. 17 and 18. In the third embodiment of the present invention, like components are denoted with like reference numerals as of the first embodiment of the present invention and are not further explained.

According to the third embodiment of the present invention, the first-third conveyance paths 401*a*-401*c* are switched not by a switching plate but by an elevating mechanism that is driven by a driving source (not shown). The elevating mechanism vertically moves the conveyance path 401-403 for switching the path for conveying the paper 5. Accordingly, the first-third conveyance paths 401*a*-401*c* are all straight conveyance paths. With this configuration, standby conveyance can be performed even where the conveyance object 5 is made of a material having a relatively high rigidity or a material having an unbendable property such as a plastic material (CD), cardboard paper, or glossy paper. In other words, by forming the conveyance paths 401*a*-401*c* with a substantially straight configuration, a conveyance object 5 having a relatively firm property can be conveyed. It is to be noted that the standby process performed with the first-third conveyance paths 401*a*-401*c* are substantially the same as that described in the first embodiment of the present invention.

Figure 19:
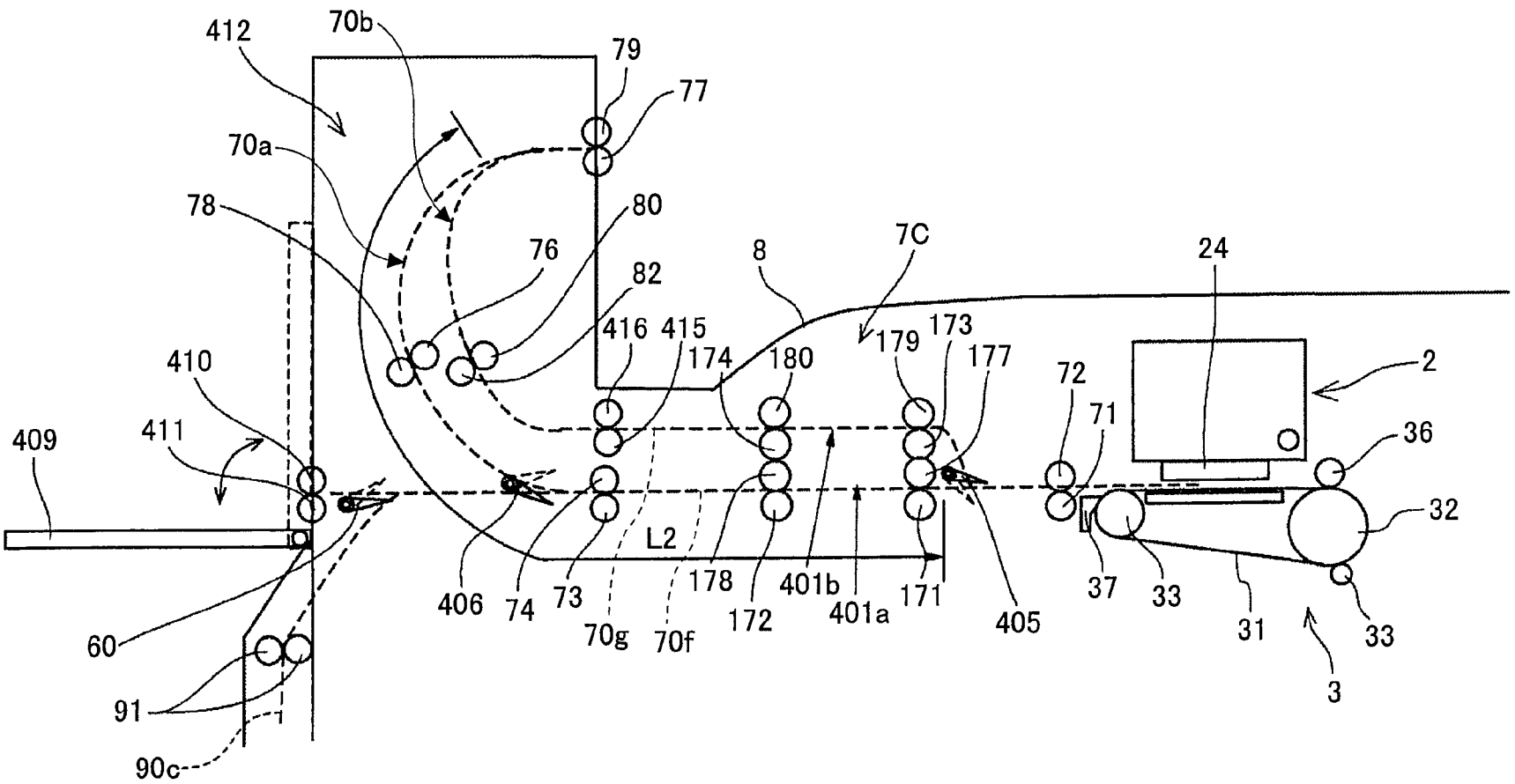
FIG. 19 is a schematic diagram showing a conveying apparatus according to a fourth embodiment of the present invention.

Next, a conveying apparatus 7C according to the fourth embodiment of the present invention is described with reference with FIG. 19. According to the fourth embodiment of the present invention, the conveying apparatus 7C has two standby conveyance paths which are a first conveyance path 70*f* and a second conveyance path 70*g*. The first conveyance path 70*f* is configured as a path connecting the above-described first conveyance path 401*a* and the first sheet-discharge conveyance path 70*a* together. The second conveyance path 70*g* is configured as a path connecting the above-described second conveyance path 401*b* and the second sheet-discharge conveyance path 70*b* together. With this configuration, the length L2 of the paper 5, which can put in a standby state, can be extended. Thereby, the standby mode can be performed for a paper 5 having a relatively large size.

Alternatively, the length of the first and second conveyance paths 70*f*, 70*g* allows two sheets of paper 5 to be placed on a single conveyance path. In other words, a total of four sheets of paper 5 can be put in a standby state on the first and second conveyance paths 70*f*, 70*g* (L2≥L1×2). In a case of distributing (conveying) four sheets of paper 5 (fed in an order from paper 5A to paper 5D), the first and second papers 5A and 5B are conveyed to the first conveyance path 70*f* and put in a standby state on the first conveyance path 70*f*. Then, the third and fourth papers 5C and 5D may be conveyed to the second conveyance path 70*g* and put in a standby state on the second conveyance path 70*g*. Alternatively, the third and fourth paper 5C and 5D may be alternately conveyed to the first and second conveyance paths 70*f* and 7*g*, and put in a standby state on the first and second conveyance paths 70*f* and 70*g*, respectively. It is, however, to be noted that the method for conveying and putting the papers 5 in the standby state is not limited to that described in the fourth embodiment of the present invention.

Figure 20:
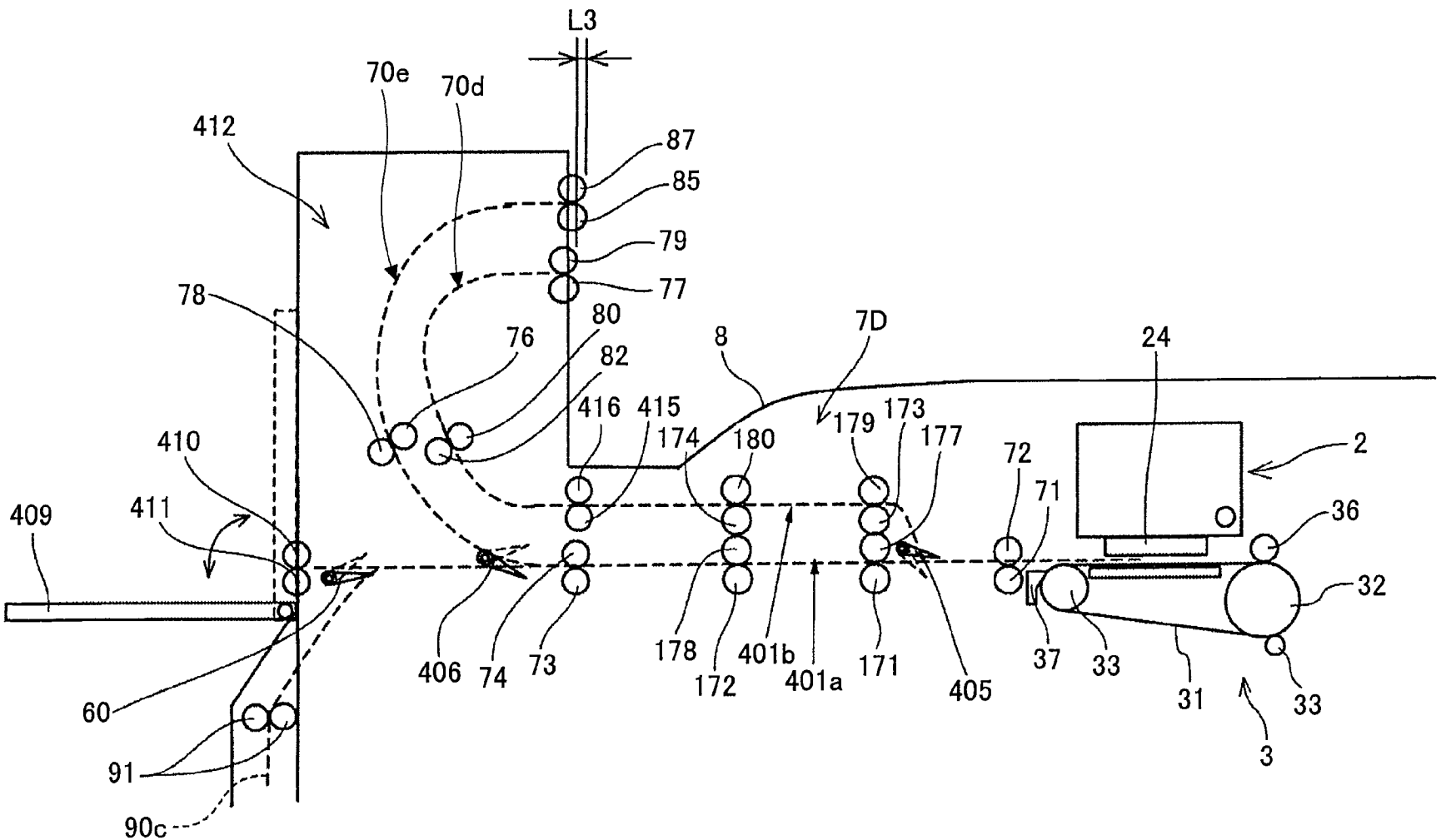
FIG. 20 is a schematic diagram showing a conveying apparatus according to a fifth embodiment of the present invention.

Next, a conveying apparatus 7D according to a fifth embodiment of the present invention is described with reference to FIG. 20.

According to the fifth embodiment of the present invention, a first pair of sheet-discharge rollers 77 and 79 is provided to a first conveyance path 70*d*, and a second pair of sheet-discharge rollers 85 and 87 is provided to a second conveyance path 70*e*.

With this configuration, the length of the paper 5, which can put in a standby state, can be extended. Furthermore, since the paper 5 can be conveyed and put in a standby state to point beyond the first and second pairs of sheet-discharge rollers 77, 79, 85, 87, the limit in the length of the paper 5 can substantially be eliminated. It is to be noted that the first pair of sheet-discharge rollers 77 and 79 is positioned more downstream in the sheet-discharge direction than the second pair of sheet-discharge rollers 85 and 87 for a length (distance) of L3. It is to be noted that the standby process performed with the first and second conveyance paths 70*d* and 70*e* are substantially the same as that described in the first embodiment of the present invention.

Figure 21:
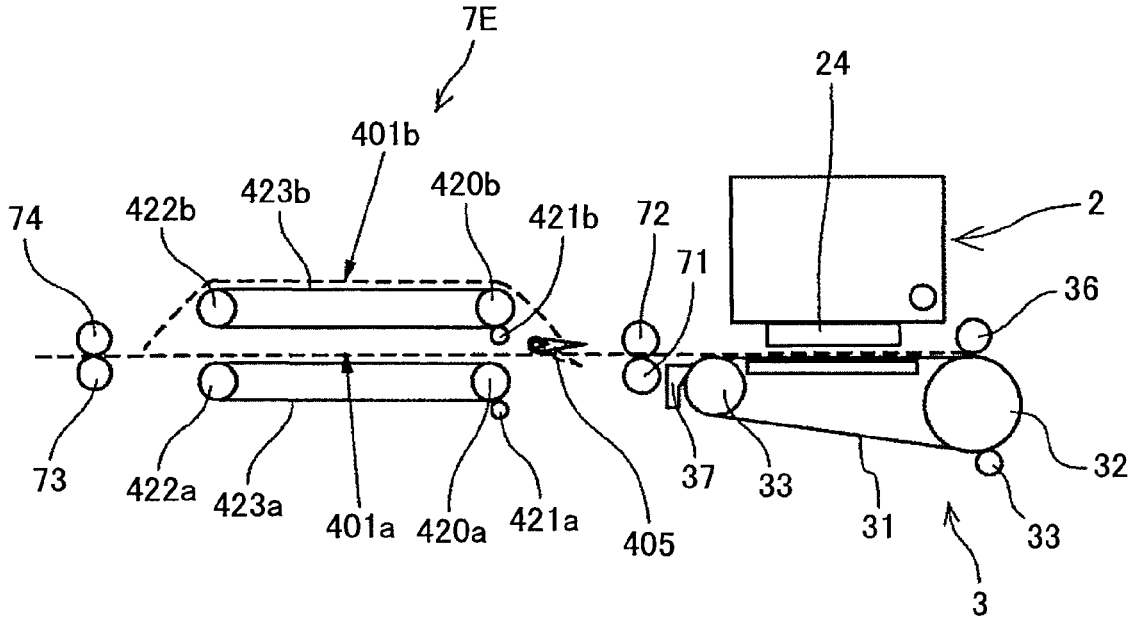
FIG. 21 is a schematic diagram showing a conveying apparatus according to a sixth embodiment of the present invention.

Next, a conveying apparatus 7E according to a sixth embodiment of the present invention is described with reference to FIG. 21.

According to the sixth embodiment of the present invention, the conveying apparatus 7*e* has a first electrostatic attraction belt 423*a* serving as the first conveyance path 401*a* and a second electrostatic attraction belt 423*b* serving as the second conveyance path 401*b*. The first electrostatic attraction belt 423*a* is wound around a conveying roller 422*a* and a driven roller 421*a* for applying a tensile force to the first electrostatic attraction belt 423*a*. The second electrostatic attraction belt 423*b* is wound around a conveying roller 422*b* and a driven roller 421*b* also for applying a tensile force to the second electrostatic attraction belt 423*a*. The conveying apparatus 7*e* also includes charging rollers (charging parts) 421*a*, 421*b* for applying alternate high voltage from a high voltage power source to the surfaces 423*a*, 423*b* of the first and second electrostatic attraction belts 423*a*, 423*b*. Accordingly, the first and second electrostatic attraction belts 423*a*, 423*b* electrostatically attract the paper 5 thereon for conveying and putting the paper 5 in a standby state. Thereby, the paper 5 can be put in a standby state in a flattened (corrected) manner. This allows the curled paper 5 to be corrected or dried in a shorter amount of standby time. This minimizes reduction of productivity. Furthermore, this configuration uses no components (e.g., spurs) which directly contact the conveyed paper 5. Thus, even in a case of conveying a paper 5 which is not sufficiently dried, staining of the paper 5 can be prevented. It is to be noted that the standby process performed with the first and second electrostatic attraction belts 423*a* and 423*b* are substantially the same as that described in the first embodiment of the present invention.

Figure 22:
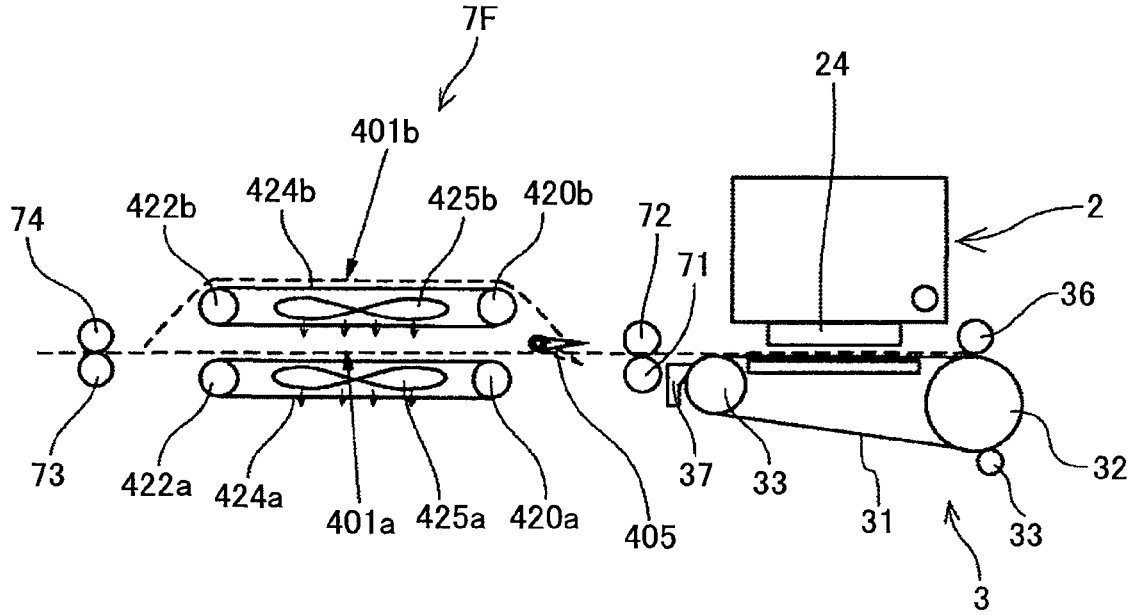
FIG. 22 is a schematic diagram showing a conveying apparatus according to a seventh embodiment of the present invention.

Next, a conveying apparatus 7F according to a seventh embodiment of the present invention is described with reference to FIG. 22. According to the seventh embodiment of the present invention, the conveying apparatus 7F includes a first and second conveyor belt 424*a*, 424*b* having an opening(s) formed thereto for enabling air suction. In the seventh embodiment of the present invention, the first and second conveyor belts 424*a*, 424*b* serve as the first and second conveyance paths 401*a*, 401*b*, respectively. The first conveyor belt 424*a* is wound around a conveying roller 422*a* and a driven roller 420*a* for applying a tensile force to the first conveyor belt 424*a*. The second conveyor belt 424*b* is wound around a conveying roller 422*b* and a driven roller 420*b* also for applying a tensile force to the second conveyor belt 424*b*. On the back of the first and second conveyor belts 424*a*, 424*b*, first and second attraction fans 425*a*, 425*b* are provided for attracting the paper 5 to the first and second conveyor belts 424*a*, 424*b* by air suction. Accordingly, the first and second conveyor belts 424*a*, 424*b* attract the paper 5 thereon with use of air suction for conveying and putting the paper 5 in a standby state.

Thereby, the paper 5 can be put in a standby state in a flattened (corrected) manner. This allows the curled paper 5 to be corrected or dried in a shorter amount of standby time. This minimizes reduction of productivity. Furthermore, this configuration uses no components (e.g., spurs) which directly contact the conveyed paper 5. Thus, even in a case of conveying a paper 5 which is not sufficiently dried, staining of the paper 5 can be prevented. It is to be noted that the standby process performed with the first and second conveyor belts 424*a* and 424*b* are substantially the same as that described in the first embodiment of the present invention.

Figure 23:
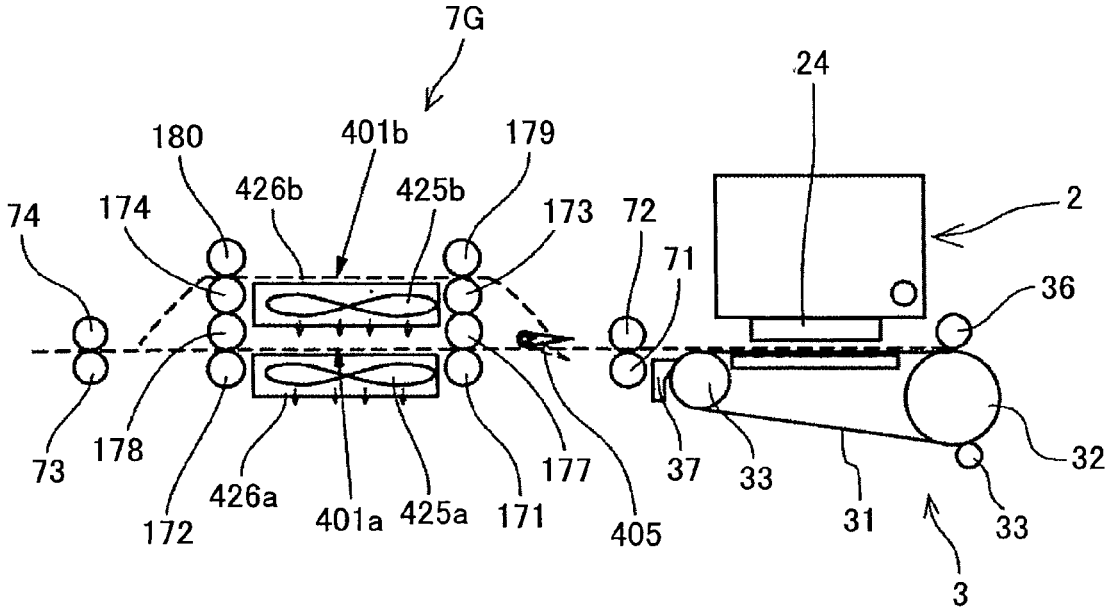
FIG. 23 is a schematic diagram showing a conveying apparatus according to an eighth embodiment of the present invention.

Next, a conveying apparatus 7G according to an eighth embodiment of the present invention is described with reference to FIG. 23.

According to the eighth embodiment of the present invention, the conveying apparatus 7G includes: first and second conveying guides 426*a*, 426*b* having an opening(s) to which for the paper 5 is attracted by air suction; first and second air suction fans for performing air suction with the first and second conveying guides 426*a*, 426*b*; a first pair of conveying rollers 171, 172, and a second pair of conveying rollers 173 and 174 for conveying the paper 5; and a first pair of spurs 177 and 178 facing the first pair of conveying rollers 171 and 172, and a second pair of spurs 179 and 180 facing the second pair of conveying rollers 173 and 174. In the eighth embodiment of the present invention, the first and second conveying guides 426*a*, 426*b* serve as the first and second conveyance paths 401*a*, 401*b*, respectively.

Accordingly, the first and second conveying guides 426*a*, 426*b* attract the paper 5 thereon with use of air suction for conveying and putting the paper 5 in a standby state.

Thereby, the paper 5 can be put in a standby state in a flattened (corrected) manner. This allows the curled paper 5 to be corrected or dried in a shorter amount of standby time. This minimizes reduction of productivity. It is to be noted that the standby process performed with the first and second conveying guides 426*a* and 426*b* are substantially the same as that described in the first embodiment of the present invention.

It is to be noted that the standby process performed with the first-third conveyance paths 401*a*-401*c* are the same as that described in the first embodiment of the present invention. It is to be noted that the standby process performed with the first-third conveyance paths 401*a*-401*c* are the same as that described in the first embodiment of the present invention. The first electrostatic attraction belt 423*a* is wound around a conveying roller 422*a* and a driven roller 421*a* for applying a tensile force to the first electrostatic attraction belt 423*a*. The second electrostatic attraction belt 423*b* is wound around a conveying roller 422*b* and a driven roller 421*b* also for applying a tensile force to the second electrostatic attraction belt 423*a*. Accordingly, the first and second electrostatic attraction belts 423*a*, 423*b* electrostatically attract the paper 5 thereon for conveying and putting the paper 5 in a standby state. Thereby, the paper 5 can be put in a standby state in a flattened (corrected) manner. This allows the curled paper 5 to be corrected or dried in a shorter amount of standby time. This minimizes reduction of productivity. Furthermore, this configuration uses no components (e.g., spurs) which directly contact the conveyed paper 5. Thus, even in a case of conveying a paper 5 which is not sufficiently dried, staining of the paper 5 can be prevented. It is to be noted that the standby process performed with the first and second electrostatic attraction belts 423*a* and 423*b* are substantially the same as that described in the first embodiment of the present invention. Accordingly, the first and second conveyor belts 424*a*, 424*b* attract the paper 5 thereon with use of air suction for conveying and putting the paper 5 in a standby state. In the seventh embodiment of the present invention, the first and second conveyor belts 424*a*, 424*b* serve as the first and second conveyance paths 401*a*, 401*b*, respectively. Thereby, the paper 5 can be put in a standby state in a flattened (corrected) manner. This allows the curled paper 5 to be corrected or dried in a shorter amount of standby time. This minimizes reduction of productivity. Furthermore, this configuration uses no components (e.g., spurs) which directly contact the conveyed paper 5. Thus, even in a case of conveying a paper 5 which is not sufficiently dried, staining of the paper 5 can be prevented. It is to be noted that the standby process performed with the first and second conveyor belts 424*a* and 424*b* are substantially the same as that described in the first embodiment of the present invention.

Figure 24:
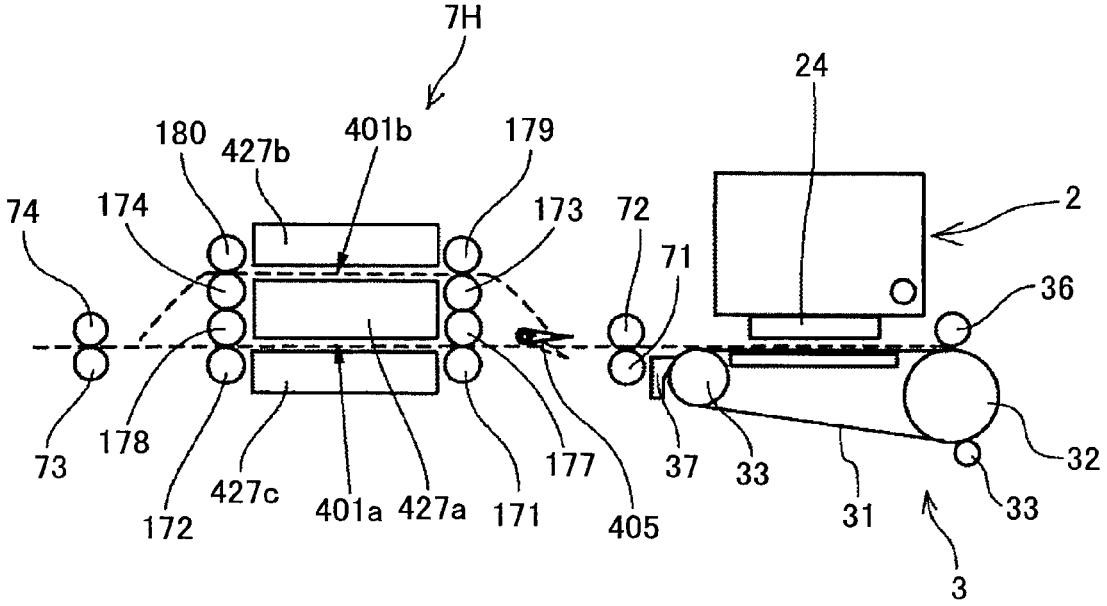
FIG. 24 is a schematic diagram showing a conveying apparatus according to a ninth embodiment of the present invention.

Next, a conveying apparatus 7H according to a ninth embodiment of the present invention is described with reference to FIG. 24.

According to the ninth embodiment of the present invention, the conveying apparatus 7H includes: first, second, and third conveying guides 427*a*, 427*b*, 427*c* each having a heating apparatus for accelerating drying of the paper 5; a first pair of conveying rollers 171, 172, and a second pair of conveying rollers 173 and 174 for conveying the paper 5; and a first pair of spurs 177 and 178 facing the first pair of conveying rollers 171 and 172, and a second pair of spurs 179 and 180 facing the second pair of conveying rollers 173 and 174. Accordingly, the paper 5 is conveyed on the first and second conveyance paths 401*a*, 401*b* while being dried by the first, second, and third conveying guides 427*a*, 427*b*, 427*c*.

Thereby, the paper 5 can be put in a standby state while having its drying speed accelerated. This allows the curled paper 5 to be corrected or dried in a shorter amount of standby time. This minimizes reduction of productivity. The method for transmitting the heat for heating the paper 5 may be, for example, a conductive heat transferring method, a convective heat transferring method, or a radiant heat transferring method. Furthermore, the method for heating the paper may be, for example, microwave heating, electromagnetic induction heating, radiant heating, or electric resistance heating. The position in which the heating apparatus is provided to the first-third conveying guides 427*a*-427*c* is not to be limited to the configuration shown in FIG. 24. For example, the heating apparatus may be provided in a manner so that the paper 5 conveyed on the first and second conveyance paths 401*a*, 401*b* can be heated from above, below, or both sides. It is to be noted that the standby process performed with the first-third conveying guides 427*a*-427*c* are substantially the same as that described in the first embodiment of the present invention.

Figure 25:
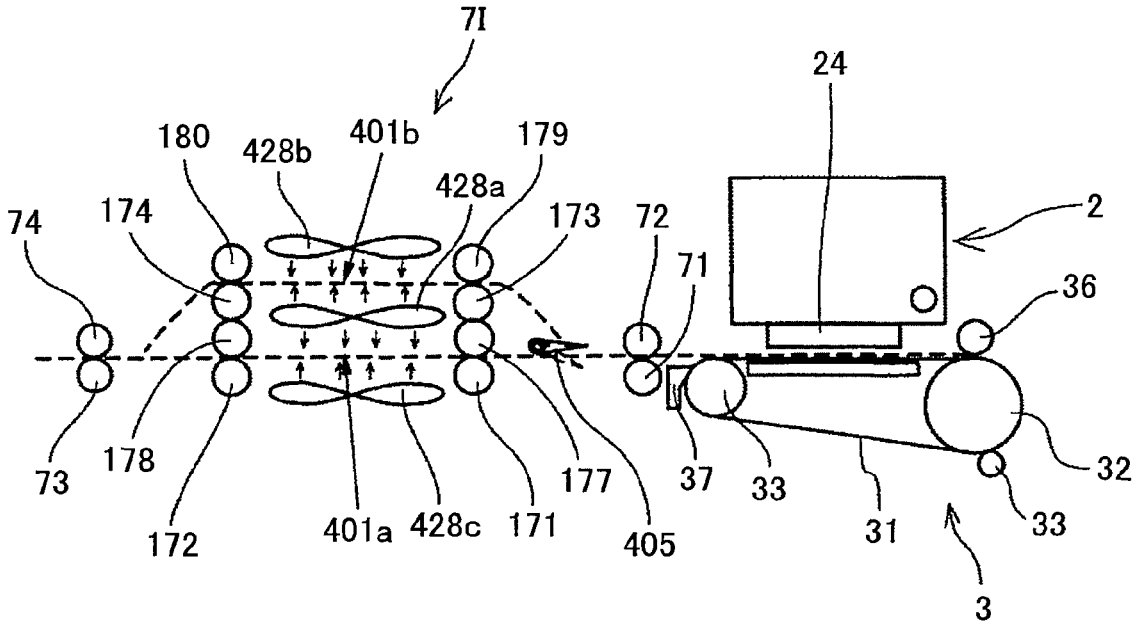
FIG. 25 is a schematic diagram showing a conveying apparatus according to a tenth embodiment of the present invention.

Next, a conveying apparatus 7I according to a tenth embodiment of the present invention is described with reference to FIG. 25.

According to the tenth embodiment of the present invention, the conveying apparatus 7I includes first, second, and third air-flow generating apparatuses 428*a*, 428*b*, and 428*c* for generating an air flow for accelerating the drying of the paper 5 conveyed on the first and second conveyance paths 401*a* and 401*b*. Accordingly, the paper 5 is conveyed and put on a standby state on the first and second conveyance paths 401*a*, 401*b* while being dried with air flow generated from the first, second, and third air-flow generating apparatuses 428*a*, 428*b*, and 428*c*.

Thereby, the paper 5 can be put in a standby state while having its drying speed accelerated. This allows the curled paper 5 to be corrected or dried in a shorter amount of standby time. This minimizes reduction of productivity. The air-flow generating apparatus may be a fan used for providing multiple functions in a case where, for example, a duct is provided in the vicinity of an exhaust fan for guiding the air from the exhaust fan to the paper 5. Other than the first, second, and third air-flow generating apparatuses 428*a*, 428*b*, and 428*c*, the standby process performed with the configuration of tenth embodiment of the present invention is substantially the same as that described in the first embodiment of the present invention.

It is to be noted that the first through tenth embodiments of the present invention may be used in combination for attaining an enhanced effect. For example, by combining the ninth and tenth embodiments of the present invention, the heat from the heating apparatus positioned along the first and second conveyance paths 401*a* and 401*b* can be effectively applied to the paper 5 by using the fan (air-flow generating apparatuses 428*a*-428*c*).

Figure 26:
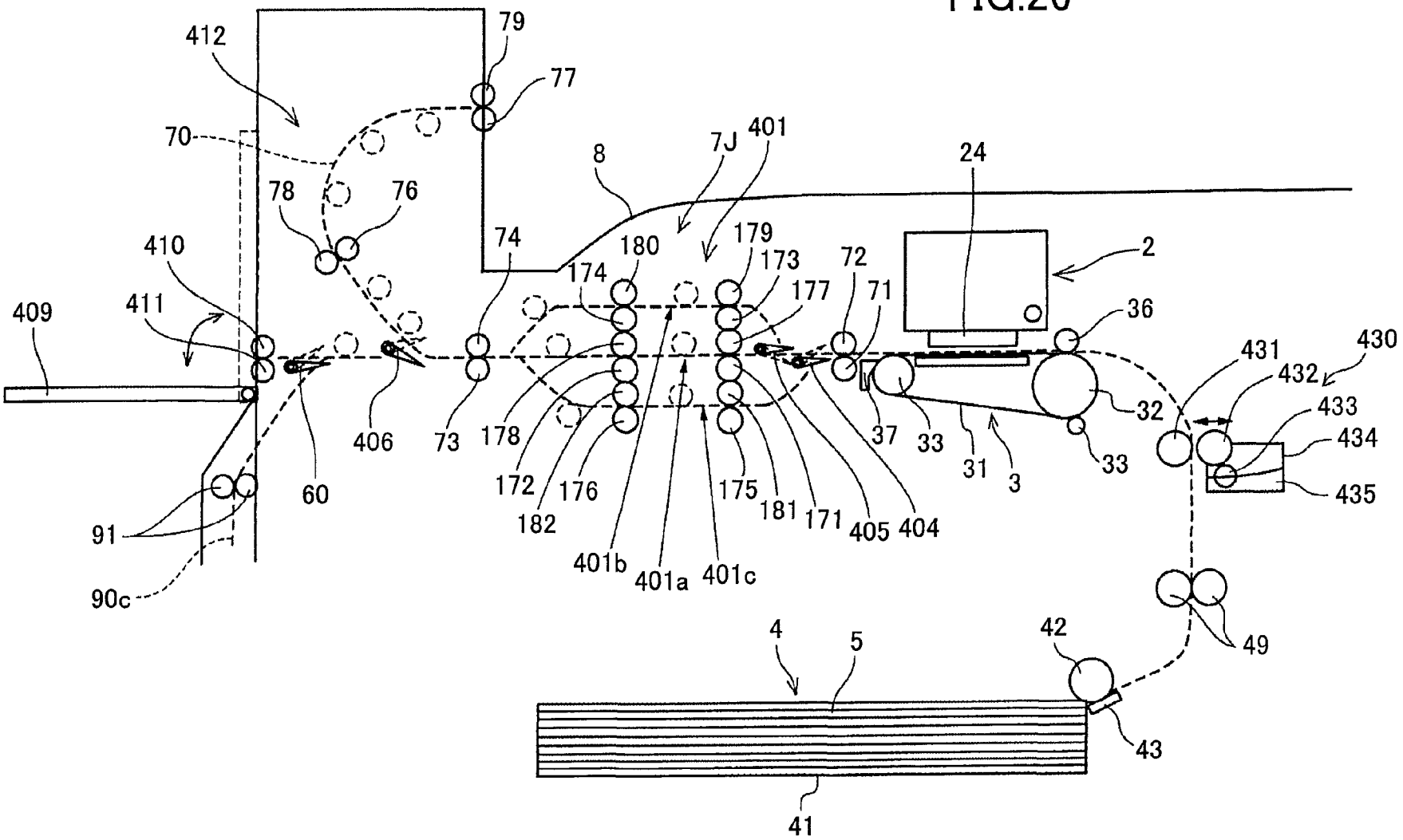
FIG. 26 is a schematic diagram showing a conveying apparatus according to an eleventh embodiment of the present invention.

Next, a conveying apparatus 7J according to an eleventh embodiment of the present invention is described with reference to FIG. 26.

According to the eleventh embodiment of the present invention, the above-described image forming apparatus 1000 according to the first embodiment of the present invention includes a coating apparatus 430 for coating a treating liquid (treatment) that enables liquid droplets (e.g., ink droplets) to react and fix to the liquid droplets. The coating apparatus 430 includes a replaceable treating liquid cassette 434, a treating liquid 435 contained in the cassette 434, a coating roller 432 for applying a coat of the treating liquid 435 onto the surface of the paper 5, an intermediate roller 433 for evenly coating the treating liquid 435 on the coating roller 432, and a conveyor roller 431 having satisfactory corrosion resistance (e.g., nitrile rubber). The surface of the intermediate roller 433 is formed of, for example, a foamed material, or a fibrous brush. The coating roller 432 has a fine concavo-convexo surface for holding the liquid with surface tension or with capillarity (capillary attraction). The surface of the coating roller 432 may be formed of an inelastic material such as metal, ceramic, or plastic. Although a foamed material, a fibrous material, or a fabric material may also be used, it is preferable to use an inelastic material especially in a case of coating a small amount of liquid. The coating roller 432 is driven to contact and separates from the paper 5 by a driving part (not shown) according to circumstance.

Accordingly, by coating the treating liquid onto the paper 5, according to a predetermined condition, the standby time can be relatively shortened. Thereby, productivity can be improved.

The treating liquid may be a material providing various functions and characteristics (a luminous property, a light blocking property, a conductive property, a fixing property, a glossy property, a liquid absorbing property). The treating liquid may be changed by replacing the treating liquid cassette 434 with another treating liquid cassette 434. Although the coating apparatus 430 according to this embodiment of the present invention is used in an image forming apparatus 1000 having an image forming part 2, the coating apparatus 430 may alternatively be used in a configuration including only the coating apparatus 430 and the conveying apparatus 7. Other than the coating apparatus 430, the standby process performed with the configuration of eleventh embodiment of the present invention is substantially the same as that described in the first embodiment of the present invention.

Figure 27:
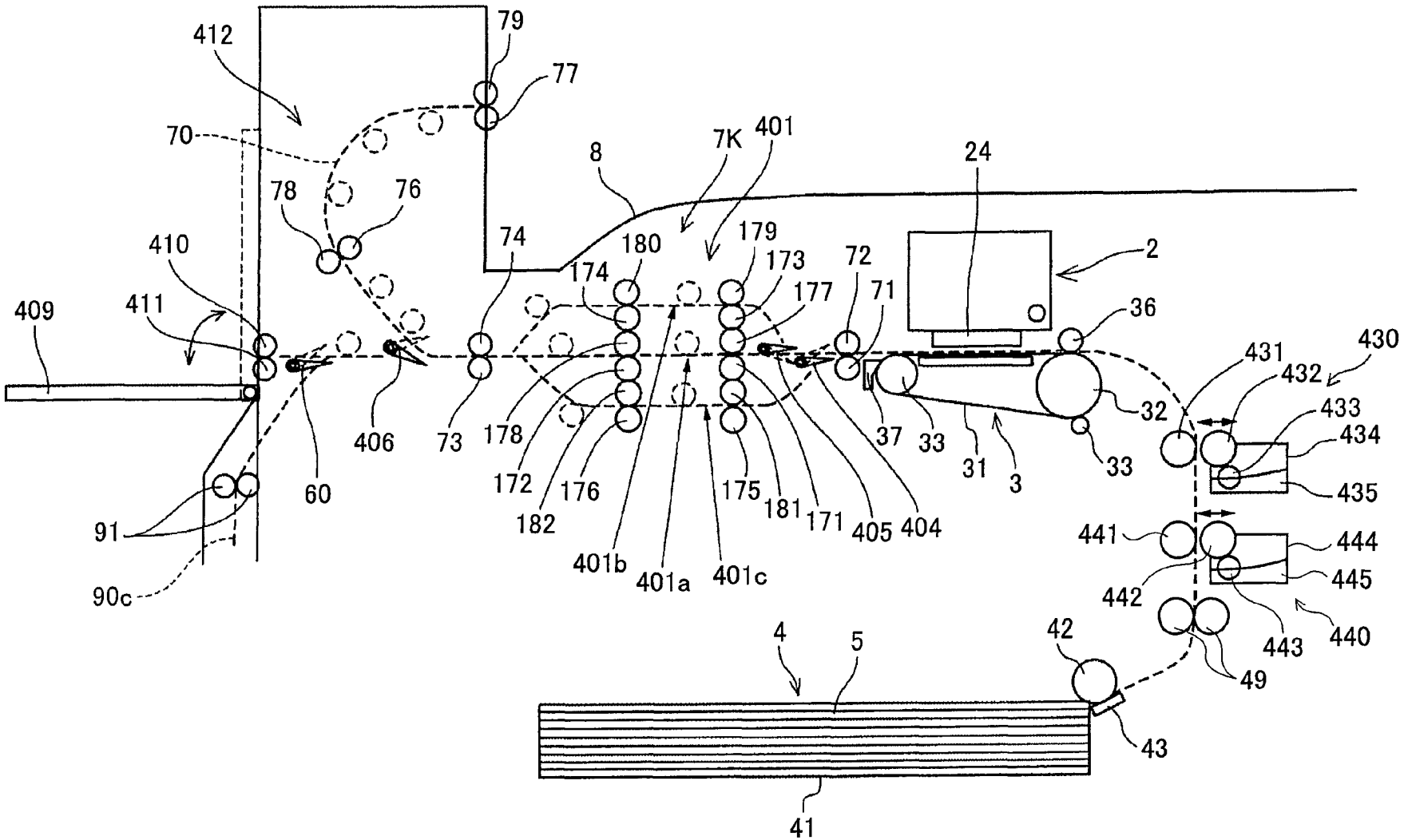
FIG. 27 is a schematic diagram showing a conveying apparatus according to a twelfth embodiment of the present invention.

Next, a conveying apparatus 7I according to a twelfth embodiment of the present invention is described with reference to FIG. 27.

According to the twelfth embodiment of the present invention, in addition to the coating apparatus 430, the above-described image forming apparatus 1000 according to the first embodiment of the present invention also includes a coating apparatus 440 for coating another treating liquid (treatment) on a non-printing side of the paper 5 for preventing curling of the paper 5. The coating apparatus 440 includes a replaceable treating liquid cassette 444, a curl prevention treating liquid 445 contained in the cassette 444, a coating roller 442 for applying a coat of the treating liquid 445 onto the surface of the paper 5, an intermediate roller 443 for evenly coating the treating liquid 445 on the coating roller 442, and a conveyor roller 441 having satisfactory corrosion resistance (e.g., nitrile rubber). The surface of the intermediate roller 443 is formed of, for example, a foamed material, or a fibrous brush. The coating roller 442 has a fine concavo-convexo surface for holding the liquid with surface tension or with capillarity (capillary attraction). The surface of the coating roller 442 may be formed of an inelastic material such as metal, ceramic, or plastic. Although a foamed material, a fibrous material, or a fabric material may also be used, it is preferable to use an inelastic material especially in a case of coating a small amount of liquid. The coating roller 442 is driven to contact and separates from the paper 5 by a driving part (not shown) according to circumstance.

For example, the printing area or printing distribution is determined prior to a sheet-feeding process based on image data transferred from an outside apparatus (host side) or image data read out by the image reading apparatus 11. Based on the determination results, the curl prevention treating liquid is applied to a non-printing area in the vicinity of a printing area of the paper 5 via the coating roller 443. By applying substantially an equal amount of liquid onto both sides of the paper 5, the expansion of paper 5 occurring in the paper (fibers of the paper) is substantially the same on both sides. Thereby, curling of the paper 5 can be prevented. Accordingly, a relatively short time is needed to be set (determined) as the standby time. Thereby, productivity can be improved.

Furthermore, the method of coating the treating liquid is not limited to those explained in the above-described embodiments of the present invention. For example, the treating liquid may be applied by using a spraying type coating apparatus. Furthermore, the type of treating liquid is not to be limited to that explained in the above-described embodiments of the present invention. The coating apparatus 240 may be used without the image forming part 2. For example, the treating liquid 435 or the curl prevention treating liquid 445 may be applied on one side or both sides of the paper 5 by using the coating apparatuses 430 and 440. Then, the paper 5 may be conveyed and put in a standby state by the conveying apparatus 7 for drying and curl prevention. Then, the paper 5 may be, for example, conveyed to the double-side printing unit 10 and re-fed, so that recording (printing) can be performed on the paper 5 by a recording part (not shown) where the treating liquids 435, 445 coated on the paper 5 are in a dry state.

Hence, according to the above-described embodiments of the present invention, by using a liquid applying apparatus having a coating apparatus (e.g., roller type coating apparatus, brush type coating apparatus, a spray type coating apparatus) and a conveying apparatus, liquid can be coated on various types of paper (conveyance object) with a simple configuration (method) while improving both drying and productivity. Furthermore, energy savings and cost reduction can be achieved. Furthermore, in using a liquid jetting apparatus as a liquid applying part (liquid applying apparatus), various processes can be performed on a large variety of media (e.g., papers) by using a non-contact type process (e.g., non-contact type image forming method). In addition, liquid coating precision can be improved by being able to jet liquid droplets with high precision and form dots of fine size. Furthermore, both productivity and drying can be improved. Furthermore, energy savings and cost reduction can be achieved.

The above-described embodiments of the present invention can be effectively applied to a case where a pigment type ink (having a viscosity no less than 5 mPa·s in a temperature of 25° C.) is used as a recording liquid since curling is likely to occur when such pigment type ink is used. Thereby, image quality can be improved by forming images having satisfactory characteristics (e.g., high image density, sufficient color development, low bleeding, high double-side printing performance, high water-resistance, high quick-drying property) by using the pigment type ink while also improving drying and productivity. Furthermore, the above-described embodiments of the present invention also save energy and reduce manufacturing cost.

Further, the present invention is not limited to these embodiments, but variations and modifications may be made without departing from the scope of the present invention.

The present application is based on Japanese Priority Application No. 2007-053238 filed on Mar. 2, 2007, with the Japanese Patent Office, the entire contents of which are hereby incorporated by reference.

The invention claimed is:

1. A conveying apparatus comprising:

a plurality of conveyance paths arranged in parallel and configured to receive a plurality of conveyance objects fed from an upstream side of the plural conveyance paths and convey the received plural conveyance objects to a conveyance destination situated at a downstream side of the plural conveyance paths;

wherein for each conveyance path of the plurality of conveyance paths, a conveyance direction from the upstream side of the conveyance path towards the downstream side of the particular conveyance path is the same as the conveyance direction of each of the others of the plurality of conveyance paths, and wherein the plural conveyance paths are configured to convey the plural conveyance objects in the order in which the plural conveyance objects are received;

a flip-over path disposed at the downstream side of the plural conveyance paths and configured to flip over the conveyance objects; and a delaying part for delaying the conveyance of the plural conveyance objects for each of the plural conveyance paths by temporarily stopping the conveyance of the plural conveyance objects or reducing the rate of conveying the plural conveyance objects, wherein the delaying part changes the number of conveyance paths to be used, based on a duration of standby time that is adjusted by temporarily stopping or delaying the conveyance of the plural conveyance objects with the delaying part, wherein the plural conveyance paths are configured to convey the plural conveyance objects in a single conveyance direction, and wherein the plural conveyance paths merge after conveying the plural conveyance objects in parallel in the same conveyance direction, and the flip-over path is disposed downstream of a position in which the plural conveyance paths are merged.

2. The conveying apparatus as claimed in claim 1, further comprising:

a selecting part for selecting one or more of the plural conveyance paths according to the time to be delayed by the delaying part.

3. The conveying apparatus as claimed in claim 1, wherein the plural conveyance paths merge at a point before the conveyance destination situated at the downstream side of the plural conveyance paths.

4. The conveying apparatus as claimed in claim 1, further comprising:

a variable control part for variably controlling the time to be delayed by the delaying part according to a predetermined condition.

5. The conveying apparatus as claimed in claim 4, wherein the predetermined condition can be set or changed from an outside apparatus in communication with the conveying apparatus or a control panel.

6. The conveying apparatus as claimed in claim 4, wherein the conveyance object has a liquid applied thereto, wherein the predetermined condition is the amount of liquid applied to the conveyance object.

7. The conveying apparatus as claimed in claim 6, wherein the amount of liquid is the amount of liquid applied to a predetermined part of the conveyance object.

8. The conveying apparatus as claimed in claim 1, further comprising:

a selecting part for selecting between a mode for delaying the timing of conveying the plural conveyance objects and a mode for not delaying the timing of conveying the plural conveyance objects according to a predetermined condition, wherein the predetermined condition is set or changed from an outside apparatus in communication with the conveying apparatus or a control panel.

9. The conveying apparatus as claimed in claim 8, wherein the conveyance object has a liquid applied thereto, wherein the predetermined condition is the amount of liquid applied to the conveyance object.

10. The conveying apparatus as claimed in claim 9, wherein the amount of liquid is the amount of liquid applied to a predetermined part of the conveyance object.

11. The conveying apparatus as claimed in claim 1, wherein the conveyance destination is a discharging part for discharging the plural conveyance objects.

12. The conveying apparatus as claimed in claim 1, wherein the conveyance destination is a flip-over conveyance path used when forming images on both sides of the conveyance object.

13. The conveying apparatus as claimed in claim 1, further comprising:

an attracting part configured to attract the plural conveyance objects onto at least one of the plural conveyance paths for delaying the timing of conveying the plural conveyance objects.

14. The conveying apparatus as claimed in claim 1, further comprising:

a heating part situated at least at one of the plural conveyance paths for heating the plural conveyance objects.

15. The conveying apparatus as claimed in claim 1, further comprising:

a air blowing part situated at least at one of the plural conveyance paths for blowing air to the plural conveyance objects.

16. A liquid applying apparatus comprising:

a liquid applying part for applying a liquid to a recording medium; and the conveying apparatus as claimed in claim 1 for conveying the recording medium;

wherein the liquid applying part includes a roller type coating apparatus, a brush type coating apparatus, or a spray type coating apparatus, or a liquid jet type apparatus configured to jet liquid droplets onto the recording medium.

17. An image forming apparatus for forming an image on a recording medium, the image forming apparatus comprising:

the conveying apparatus as claimed in claim 1 for conveying the recording medium.

18. The image forming apparatus as claimed in claim 17, further comprising:

a liquid jet type apparatus configured to jet liquid droplets to the recording medium.

19. The conveying apparatus as claimed in claim 1, wherein the conveying apparatus is disposed in an image forming apparatus including an image forming part, and each particular conveyance path of the plurality of conveyance paths is disposed to convey a sheet bearing an image formed by the image forming part, in the conveyance direction from the upstream side of the particular conveyance path towards the downstream side of the particular conveyance path.

* * * * *